US010220291B2

(12) United States Patent
Kordecki

(10) Patent No.: US 10,220,291 B2
(45) **Date of Patent: *Mar. 5, 2019**

(54) PROTECTIVE SHOULDER PADS WITH RELEASE MECHANISM

(71) Applicant: Riddell, Inc., Rosemont, IL (US)

(72) Inventor: Michael E Kordecki, Vernon Hills, IL (US)

(73) Assignee: Riddell, Inc., Des Plaines, IL (US)

( * ) Notice: Subject to any disclaimer, the term of this patent is extended or adjusted under 35 U.S.C. 154(b) by 85 days.

This patent is subject to a terminal disclaimer.

(21) Appl. No.: 15/166,963

(22) Filed: May 27, 2016

(65) Prior Publication Data

US 2016/0271483 A1 Sep. 22, 2016

Related U.S. Application Data

(63) Continuation of application No. 13/554,760, filed on Jul. 20, 2012, now Pat. No. 9,352,210, which is a continuation-in-part of application No. 12/793,050, filed on Jun. 3, 2010, now Pat. No. 8,776,275, which is a continuation-in-part of application No. 12/290,510, filed on Oct. 31, 2008, now Pat. No. 8,087,102.

(51) Int. Cl.

| | |
|---|---|
| ***A63B 71/12*** | (2006.01) |
| ***A41D 13/05*** | (2006.01) |
| *A63B 102/24* | (2015.01) |
| *A63B 102/14* | (2015.01) |

(52) U.S. Cl.

CPC ..... *A63B 71/12* (2013.01); *A41D 13/0512* (2013.01); *A41D 13/0568* (2013.01); *A63B 2071/1208* (2013.01); *A63B 2102/14* (2015.10); *A63B 2102/24* (2015.10); *A63B 2243/007* (2013.01)

(58) Field of Classification Search

CPC ..... A63B 71/12; A63B 2071/1208; A63B 2243/007; A41D 13/0568; A41D 13/0512

See application file for complete search history.

(56) References Cited

U.S. PATENT DOCUMENTS

| | | | |
|---|---|---|---|
| 1,298,618 | A | 3/1919 | Wloszek |
| 2,477,989 | A | 8/1949 | LaMaida |
| 3,087,163 | A | 4/1963 | Kelly |
| 3,431,560 | A | 3/1969 | Austin |

(Continued)

FOREIGN PATENT DOCUMENTS

| | | |
|---|---|---|
| WO | 2008108856 | 9/2008 |
| WO | 2009051619 | 4/2009 |

*Primary Examiner* — Khaled Annis

(74) *Attorney, Agent, or Firm* — Barnes and Thornburg LLP

(57) ABSTRACT

Protective shoulder pads to be worn by an individual engaged in a contact sport, such as football, lacrosse or hockey, are provided. The shoulder pads protect an individual wearing the protective shoulder pads against impact to the superior, anterior, posterior and/or lateral regions of the shoulder and upper arm regions. The shoulder pads include a release mechanism that releasably couples left and right arch members of the shoulder pads and allows for removal of the shoulder pads from the individual while he or she is maintained in the supine position, thus decreasing the risk of further injuring the individual wearing the protective shoulder pads.

20 Claims, 19 Drawing Sheets

(56) References Cited

U.S. PATENT DOCUMENTS

| | | | |
|---|---|---|---|
| 3,514,784 | A | 6/1970 | McDavid |
| 3,740,762 | A | 6/1973 | Truelove |
| 3,740,763 | A | 6/1973 | Mitchell |
| 4,295,227 | A | 10/1981 | Mitchell |
| 4,317,237 | A | 3/1982 | Porte |
| 4,322,859 | A | 4/1982 | Mitchell |
| 4,441,211 | A | 4/1984 | Donzis |
| 4,467,475 | A | 8/1984 | Gregory et al. |
| 4,486,901 | A | 12/1984 | Donzis |
| 4,513,449 | A | 4/1985 | Donzis |
| 4,590,622 | A | 5/1986 | Wolfe et al. |
| 4,694,505 | A | 9/1987 | Flosi et al. |
| 4,872,216 | A | 10/1989 | Wingo, Jr. |
| 4,874,640 | A | 10/1989 | Donzis |
| 4,926,503 | A | 5/1990 | Wingo, Jr. |
| 4,985,931 | A | 1/1991 | Wingo, Jr. |
| 5,029,341 | A | 7/1991 | Wingo |
| 5,035,009 | A | 7/1991 | Wingo, Jr. |
| 5,063,941 | A | 11/1991 | White |
| 5,107,542 | A | 4/1992 | Zide et al. |
| D328,159 | S | 7/1992 | Donzis |
| 5,159,715 | A | 11/1992 | Jurga et al. |
| 5,204,993 | A | 4/1993 | Siemens |
| 5,235,715 | A | 8/1993 | Donzis |
| 5,337,417 | A | 8/1994 | Whiteside et al. |
| 5,404,590 | A | 4/1995 | Monica, Jr. |
| 5,487,187 | A | 1/1996 | Zide et al. |
| 5,517,699 | A | 5/1996 | Abraham, II |
| 5,530,966 | A | 7/1996 | West |
| 5,794,270 | A | 8/1998 | Howat |
| 5,794,275 | A | 8/1998 | Donzis |
| 5,881,395 | A | 3/1999 | Donzis |
| 5,987,654 | A | 11/1999 | Chartrand |
| 6,170,091 | B1 | 1/2001 | Zide et al. |
| 6,175,967 | B1 | 1/2001 | Donzis |
| 6,425,195 | B1 | 7/2002 | Donzis |
| 6,769,137 | B2 | 8/2004 | D'Annunzio |
| 6,948,188 | B2 | 9/2005 | D'Annunzio |
| 7,020,897 | B2 | 4/2006 | Johnson |
| 7,047,570 | B2 | 5/2006 | Johnson |
| 7,243,376 | B2 | 7/2007 | Johnson |
| 7,424,748 | B1 | 9/2008 | McDunn et al. |
| 7,506,384 | B2 | 3/2009 | Ide et al. |
| 7,930,773 | B2 | 4/2011 | Ide et al. |
| 7,987,523 | B2 * | 8/2011 | Cole ..... A45F 5/00 2/102 |
| 8,214,929 | B2 | 7/2012 | Kraemer et al. |
| 8,490,212 | B1 * | 7/2013 | Asher ..... A41D 1/04 2/2.5 |
| 2006/0010590 | A1 | 1/2006 | Huschke et al. |
| 2008/0263737 | A1 | 10/2008 | Parks et al. |
| 2012/0174286 | A1 * | 7/2012 | McBride ..... F41H 5/013 2/102 |

* cited by examiner

PROTECTIVE SHOULDER PADS WITH RELEASE MECHANISM

CROSS-REFERENCE TO RELATED APPLICATIONS

This application is a Continuation of U.S. application Ser. No. 13/554,760, filed Jul. 20, 2012, to be issued as U.S. Pat. No. 9,352,210, which is a Continuation in part of U.S. application Ser. No. 12/793,050 filed Jun. 3, 2010, now U.S. Pat. No. 8,776,275, which is a Continuation in part of U.S. application Ser. No. 12/290,510 filed Oct. 31, 2008, now U.S. Pat. No. 8,087,102, all of which are herein incorporated by reference as if fully set forth.

FIELD OF THE INVENTION

Embodiments of this invention relate generally to protective shoulder pads such as those worn by individuals participating in athletic activities, including contact sports. In particular, this invention improves currently available protective shoulder pads with a feature that allows emergency medical personnel or others to safely and easily remove the protective shoulder pads from the individual wearing the shoulder pads in case of suspected neck or cervical spine injury.

DESCRIPTION OF THE RELATED ART

Protective shoulder pads are commonly used by athletes and other individuals to protect the individual's shoulders, chest, upper and lower back, and upper arms from impact that may result in injury. For example, protective shoulder pads are utilized in sports where collision is inherent and produces a significant risk of injury, such as football, hockey and lacrosse. However, individuals wearing protective shoulder pads are generally reluctant to use protection for the fragile neck and upper spine because this protection significantly diminishes the mobility that athletes and other individuals desire. As a result, the neck and upper spine are more susceptible to injury than other parts of the human body.

When such neck or cervical spine injuries occur, protective shoulder pads themselves become a risk factor for iatrogenic injury during the course of initial medical evaluation and management. Currently available protective shoulder pads only allow removal as an entire unit. Known shoulder pads are designed so that energy from an impact to any portion of the pads is dissipated throughout the entire pad and minimizes the impact to the wearer. The proper technique for protective shoulder pad removal includes one member of the medical team maintaining manual stabilization of the athlete's head and neck at all times. While that member of the medical team remains in place manually stabilizing the head and neck, the injured athlete's torso is elevated to a 30-40 degree angle by flexing the athlete's lower spine and hips. Alternatively, the entire athlete must be lifted. While in this compromised position, the protective shoulder pads are then maneuvered in a manner to remove them, essentially, over the head of the injured athlete. This maneuver is extremely complicated and may potentially cause a secondary injury. Research in the field of spinal cord injury has suggested up to 25% of cervical spinal cord injured patients experience neurologic deterioration during the course of initial evaluation and management.

In the event that an individual suffers a suspected injury to the spine or neck, the current practice in the medical profession is to stabilize the individual in the supine position while diagnosing and treating the individual. The National Athletic Trainers' Association's guidelines and recommendations in this field, Prehospital Care of the Spine-Injured Athlete, incorporated by reference in its entirety, require that any athlete who is suspected of having a head and/or spinal injury should be managed as though a spinal injury exists, and if unconscious, the player is presumed to have an unstable fracture until it is proved otherwise. The guidelines further state that the improper management of a suspected spinal injury can result in a secondary injury. Head and shoulder stabilization must be maintained during any manipulation and removal of equipment to avoid cervical movement, lateral flexion and other movements which could lead to further injury.

While providing stabilization to the wearer's spine, the protective shoulder pads must be removed from the injured athlete while lying supine to aid in the diagnosis and treatment of a suspected cervical spine or neck injury. The current National Athletic Trainers' Association's guidelines and recommendations require at least four individuals to remove currently available shoulder pads. Routinely up to eight individuals may be needed to remove the currently available shoulder pads. Realizing the importance of limiting the amount of unnecessary movement during this process to prevent a secondary injury, the guidelines recommend removing the protective shoulder pads only to an extent that full access to chest, face, neck, and arms may be accessed. The National Athletic Trainers' Association's suggested method comprises the steps of cutting all soft clothing and soft portions of the shoulder pads with a knife or equivalent cutting apparatus as required to spread the two anterior halves of the protective shoulder pads that are currently available. However, the repositioning of the protective shoulder pads to this limited extent precludes sufficient access to the neck and cervical spine areas that medical personnel must access to diagnose and treat an individual with a suspected cervical spine injury.

Recent published studies by Rechtine and Horodysky at the University of Rochester have demonstrated significant motion in the cervical spine during shoulder pad removal despite the utilization of optimal techniques that are currently recommended by national athletic training and trauma specialty organizations. The consequences of such motion may include loss of one or more levels of neurologic function in the acute spinal cord injured athlete. This alone could result in a potentially ambulatory athlete becoming non-ambulatory, an independent athlete becoming dependent, or an athlete who may have independent respiration becoming respirator dependent. The human cost and the cost to society of such deterioration are enormous. No current protective shoulder pad design allows for the safe removal of the protective shoulder pads from an individual immobilized in the supine position by less than four properly trained people. Furthermore, current protective shoulder pad designs prevent both stabilization of the potentially injured athlete and an acceptable quality of radiographic imaging.

In their article Helmet and Shoulder Pad Removal in Football Players with Unstable Cervical Spine Injuries, M. C. Dahl, D. Ananthakrishnan, G. Nicandri, and R. P. Ching, the authors, while recognizing that "patient handling is often impaired due to the protective equipment worn and improper stabilization of these patients can exacerbate neurologic injury," the authors discussed alternative methods for removing protective shoulder pads and the resulting detriments caused by each method. The levitation technique was found to produce motion in the anterior and right lateral directions. The tilt technique resulted in motions in the posterior left lateral directions, and the log roll technique generated motions in the right lateral direction and had the largest amount of increased instability when comparing the intact and lesioned specimen. According to the authors, "these findings suggest that each method of equipment removal displays unique weaknesses that the practitioner should take into account."

In another study, the amount of motion that occurred during protective shoulder pad removal in a cadaver with an injured spine was evaluated and quantified. Helmet and shoulder pad removal from a player with suspected cervical spine injury. A cadaveric model. Spine. W F Donaldson, W C Lauerman, B Heil, R Blanc, T Swenson. 1998. The authors of the study concluded that shoulder pad removal in the unstable cervical spine is a complex maneuver, and that because of the motion observed in the unstable spine, shoulder pad removal should be performed in a carefully monitored setting by at least three, preferably four, trained people.

Another problem with currently available shoulder pads is that different types of protective shoulder pads are available for specific purposes, and the different types exacerbate the problems in removing the shoulder pads. Specific models of protective shoulder pads have posterior portions of the shoulder pads that protect down to the small of the user's back. The injured athlete must be moved to a greater degree to remove the shoulder pads, thus increasing the potential for a secondary injury. The weight of the wearer's torso exerted on the posterior member of the shoulder pads prevents easy removal of the shoulder pads, and as discussed, it is undesirable to move the individual wearing the protective shoulder pads. Another complication of attempting to remove protective shoulder pads over the head of an individual is the weight and mass of the individual. Large and heavy individuals are more difficult to lift and their body mass proves detrimental to the removal of the protective shoulder pads, thus requiring more movement of the individual and increasing the potential for a secondary injury in a person with a suspected neck or cervical spine injury.

One overriding problem of current shoulder pad design is that the pads must be rigid enough to dissipate the energy of impact to any particular portion of the pad across the majority of the entire shoulder pad, but this primary advantage is a significant deterrent to the ability to remove the one piece pads from an injured player in the supine position. Applicant is aware of several systems disclosing chest protection devices that may be removed quickly and references disclosing vests capable of carrying artillery that may be removed quickly, but none are designed to be rigid enough to dissipate the energy of impact across the entire structure and still be removable while the wearer remains in the supine position.

Branson et al. (WO/2008108856) disclose an antiballistic garment in which a front panel portion is attached to the shoulder and side portions by a quick-release cable and loop system. This vest system is not designed to withstand or dissipate impact and does not have to maintain a rigid structure when worn.

D'Annunzio (U.S. Pat. Nos. 6,948,188 and 6,769,137) discloses an armored vest that includes a retaining cable connecting together various portions of the vest, the retaining cable being easily removable in order to quickly separate the vest into its components.

Johnson (U.S. Pat. No. 7,020,897) discloses a cut away vest that includes a retaining cable connecting together various portions of the vest, the retaining cable being easily removable in order to quickly separate the vest into its components.

McDunn et al. (U.S. Pat. No. 7,424,748) disclose a ballistic resistant vest that includes a retaining cable connecting together the various portions of the vest, the retaining cable being easily removable in order to quickly separate the vest into its components.

Parks et al. (US 2008/0263737) disclose a ballistic resistant garment that includes a retaining cable connecting together the various portions of the vest, the retaining cable being easily removable in order to quickly separate the vest into its components.

McBride et al. (WO/2009051619) discloses a clam-shell vest in which a front panel portion is attached to the shoulder and side portions by a quick-release cable, loop and plunger system.

These references disclose types of apparel having a release feature providing for the disengagement of portions of the apparel from other portions of the apparel. Each of these references disclose an article of apparel that is functional to remove the front portion of the apparel from the rear portion of the apparel. The references disclose articles of apparel not designed for use as a protection device during athletic activity, but disclose apparel to be utilized during military or paramilitary activities. None of the references, taken either together or alone, disclose an article of apparel for use in a contact sport rigid enough to dissipate the energy of an impact over the entire portion of the article, having with a quick release feature used to decouple front and back portions, or left and right side posterior portions, of the apparel, wherein the quick release feature is accessible from, and activated from, the front or anterior surface of the article of apparel, and the article of apparel may be removed while the individual wearing the apparel is lying in the supine position. What is needed in the industry is an article of apparel designed for and capable of dissipating the energy of an impact received during a contact sport based upon the rigidity of the individual components of the article and is also capable of removal while the individual wearing the article is lying in the supine position.

In addition, of all of the identified shoulder pad protection devices, all utilize a rear mechanical connection between the left and right posterior portions of the shoulder pads which is neither designed for, nor capable of, disconnection while the individual wearing the shoulder pad protection device is lying in the supine position, without the need to substantially reposition the athlete in a potentially detrimental manner. Previous attempts to design shoulder pads that may be dissembled easily have failed due to their lack of rigidity and their lack of the ability to dissipate the energy due to impact across the majority of the pads.

Thus, known articles of apparel and/or known protective shoulder pads become an impediment to diagnosing and treating an individual while the individual is in the supine position and wherein the removal of the article of apparel and/or shoulder pads may potentially cause a secondary injury due to repositioning of the wearer. The removal of known protective shoulder pads requires significant movement of the wearer by at least four trained medical personnel. No known protective shoulder pad is disclosed that allows for removal of the shoulder pads and allows for sufficient access to the wearer's neck and spine while maintaining the neck and spine in a neutral position, while the wearer is in the supine position. What is needed in the industry are shoulder pads allowing for safer removal of the protective shoulder pads from a wearer while substantially immobilized in the supine position without sacrificing the rigid nature of the pads. Furthermore, what is needed in the industry are shoulder pads that promote both stabilization of the potentially injured wearer and allow an acceptable quality of radiographic imaging.

These improved protective shoulder pads according to embodiments of the present invention provide a solution to the challenges of safely removing the shoulder pads to permit diagnosing and treating suspected neck and spinal injuries. By allowing the removal of the shoulder pads while maintaining the neck and spine in the neutral position, these improved shoulder pads substantially eliminate the risk of further injury to an individual wearing shoulder pads with a suspected neck or spinal injury. The benefit of these improved protective shoulder pads is the ease and effectiveness of removal of those portions of the protective shoulder pads that typically present obstacles to the effective diagnosis and treatment. Once these portions are removed, medical personnel can more effectively diagnose and treat the individual suspected of a cervical spine or neck injury. The release mechanisms for the protective shoulder pads according to an embodiment of the present invention address the risk of increasing neurologic injury in the spinal cord injured athlete by eliminating the spinal motion demonstrated by Rechtine during shoulder pad removal while maintaining the integrity of the pads during normal use. Embodiments of the present invention provide for removal of the shoulder pads by simple release mechanisms which are easily accessible by first responders and medical professionals, while maintaining the rigidity of the pad required under normal use. Once the protective shoulder pads are safely removed, the injured athlete's spine becomes readily accessible for stabilization and radiographic evaluation.

BRIEF SUMMARY OF THE INVENTION

Responsive to the foregoing challenges, Applicant has developed a novel protective shoulder pad with a release mechanism.

An embodiment of the present invention are shoulder pads for use in a contact sport, comprising a left shoulder pad portion and a right shoulder pad portion, each with anterior, superior and posterior portions, wherein the anterior portions depend from an anterior face of the superior portions and the posterior portions depend from a posterior face of the superior portions, wherein the right and left shoulder pad portions are in communication at the anterior, superior, and posterior portions, wherein the shoulder pads are sufficiently rigid when assembled to dissipate the energy created by an impact to a portion of the pads across substantially the entire shoulder pad, and a release mechanism enabling removal of the shoulder pads while the wearer is in the supine position, wherein a portion of the release mechanism is disposed on the posterior portion of the pads, and wherein the release mechanism is operable to separate a first removable portion of the pad from a second removable portion of the pad while the wearer remains in the supine position.

The release mechanism may comprise a loop disposed on the first removable portion of the pads, an aperture disposed on the second removable portion of the pads, and a removable elongated coupler, wherein the loop is received by the aperture, and wherein the loop is retained in the aperture by the insertion of the removable elongated coupler through the loop received by the aperture thereby assembling the first and second removable portions of the pad, wherein removal of the elongated coupler from the loop permits egress of the loop from the aperture and disassembly of the first removable portion from the second removable portion while the wearer remains in the supine position. The loop may be in communication with or disposed on the right posterior portion of the pad and the aperture may be in communication with or disposed on the left posterior portion of the pad, or vice versa. The loop may be in communication with or disposed on the superior portions of the pad and the aperture may be in communication with or disposed on the posterior portions of the pad, or vice versa.

The elongated coupler may be routed from the posterior portion of the pads to the superior portion of the pads, or, in an alternative embodiment, from the posterior portion of the pads, over the superior portion of the pads, and terminating on the anterior portion of the pads. The elongated coupler may be comprised of a cable, cord, pin, strap, tie, filament, wire, tether, any other suitable structure, or any combination thereof, and may be comprised of metal, plastic, polymer, synthetic, textile, elastic, or any other suitable material.

In one embodiment of the present invention, the release mechanism may be a hinge assembly comprising a first hinge knuckle, a second hinge knuckle, and a removable elongated coupler capable of insertion through the hinge knuckles, wherein the first hinge knuckle is disposed on a first removable portion of the pads and the second hinge knuckle is disposed on a second removable portion of the pads, wherein the elongated coupler is threaded through the first knuckle and the second knuckle when the first removable portion of the pads is assembled to the second removable portion of the pads, wherein the removal of the elongated coupler from the first and second knuckles is operable when the wearer is in the supine position, and wherein removal of the elongated coupler decouples the first removable portion from the second removable portion while the wearer remains in the supine position.

The first removable portion of the pad may be the posterior portion and the second removable portion may be the superior portion. In one embodiment, the first removable portion may be the left shoulder pad portion and the second removable portion may be the right shoulder pad portion. The elongated coupler may be comprised of a cable, cord, pin, strap, tie, filament, wire, tether, or any other suitable structure, or any combination thereof, and may be comprised of metal, plastic, polymer, synthetic, textile, elastic, or any other suitable material.

One embodiment of the present invention are shoulder pads for use in a contact sport, comprising a left shoulder pad portion and a right shoulder pad portion, each with anterior, superior and posterior portions, the superior portion having a central opening, wherein the opposed superior portions of the left and right pad portions define the central opening. The anterior portions depend from an anterior face of the superior portions and the posterior portions depend from a posterior face of the superior portions. A release mechanism operable to separate a first removable portion of the pad from a second removable portion of the pad while the wearer remains in the supine position, wherein a portion of the release mechanism is disposed on the posterior portion of the pads. A portion of the release mechanism may extend to the superior portion of the pad, and in an embodiment may extend over the superior portion of the pad and terminate on the anterior portion of the pad. In an embodiment a portion of the release mechanism may extend substantially the length of the posterior portion of the pads.

One embodiment of the present invention are shoulder pads for use in a contact sport, comprising a left shoulder pad portion and a right shoulder pad portion, each with anterior, superior and posterior portions. The superior portion having a central opening, wherein the opposed superior portions of the left and right pad portions defining the central opening. The anterior portions depend from an anterior face of the superior portions and the posterior portions depend from a posterior face of the superior portions. A release mechanism operable to separate a first removable portion of the pad from a second removable portion of the pad wherein a portion of the release mechanism is disposed on the posterior portion of the pads and extends to the superior portion of the pads disposed between the central opening and a lateral portion of the pads. In one embodiment, the release mechanism may comprise an elongated coupler extending from the posterior portion of the pads to the superior portion of the pads, wherein a first end of the elongated coupler is accessible at the superior portion of the pad. In one embodiment, the release mechanism may comprise a strap with a first end terminating in a loop and a second end in communication with the first removable portion of the pads, an aperture disposed on the second removable portion of the pads, wherein the loop is received by the aperture, and a removable elongated coupler threaded through the loop received in the aperture and retaining the first end of the strap in the aperture thereby assembling the first and second removable portions of the pad, wherein the elongated coupler extends substantially along the posterior portion of the pads, over the superior portion of the pads, having a first end terminating at the anterior portion of the pads, wherein removal of the elongated coupler from the loop permits the first end of the strap to egress back through the aperture allowing disassembly of the first removable portion from the second removable portion.

An embodiment may use mechanical fasteners or equivalent which allow for removal of the posterior portions of the protective shoulder pads from the superior portions of the protective shoulder pads while the individual wearing the protective shoulder pads is in the supine position, the posterior portions of the protective shoulder pads are attached to the superior portions of the protective shoulder pads at approximately the 3rd and 4th thoracic vertebrae. The mechanical fasteners or equivalent allow for efficient and simple detachment of the posterior portions of the protective shoulder pads from the superior, anterior, and lateral portions of the protective shoulder pads while the individual suspected of the cervical spine or neck injury is lying in the supine position. The posterior portions of the protective shoulder pads can be subsequently reattached to the remaining portions of the protective shoulder pads if desired. Alternatively, using a mechanical fastener or equivalent which allows for detachment of the left shoulder portion of the protective shoulder pads from the right shoulder portion of the protective shoulder pads while the individual wearing the shoulder pads is in the supine position, the left shoulder pad and the right shoulder pad may be separated from each other and removed from underneath the individual while the individual is lying in the supine position. The left shoulder pad and the right shoulder pad can be subsequently reattached in this alternate configuration if desired.

The weight of the individual's torso on the posterior portion of the shoulder pads becomes immaterial because there is no requirement for the individual to be repositioned to effectuate removal of the portion of the protective shoulder pads that impedes treatment and diagnosis of the suspected cervical spine or neck injury. Upon removal, medical personnel and others gain access to the location of the suspected cervical spine and neck injury to treat the injury. Additionally, radiographic imaging machines can be positioned to provide clearer images of the suspected injury while only the posterior portions of the protective shoulder pads, or in the alternative, no portions of the protective shoulder pads remain in place.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF SEVERAL VIEWS OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF THE INVENTION

Embodiments of this invention relate generally to protective shoulder pads such as those worn by individuals participating in athletic activities, including contact sports, such as, but not limited to, football, hockey, and lacrosse. In particular, these embodiments improve currently available protective shoulder pads providing a feature that allows emergency medical personnel or others to more safely and easily remove the protective shoulder pads from the individual wearing the shoulder pads in case of suspected neck or cervical spine injury without sacrificing the ability of the pads to dissipate the force of an impact while the pads are in normal use. Reference will now be made in detail to embodiments of the present invention, examples of which are illustrated in the accompanying drawings.

Figure 1:
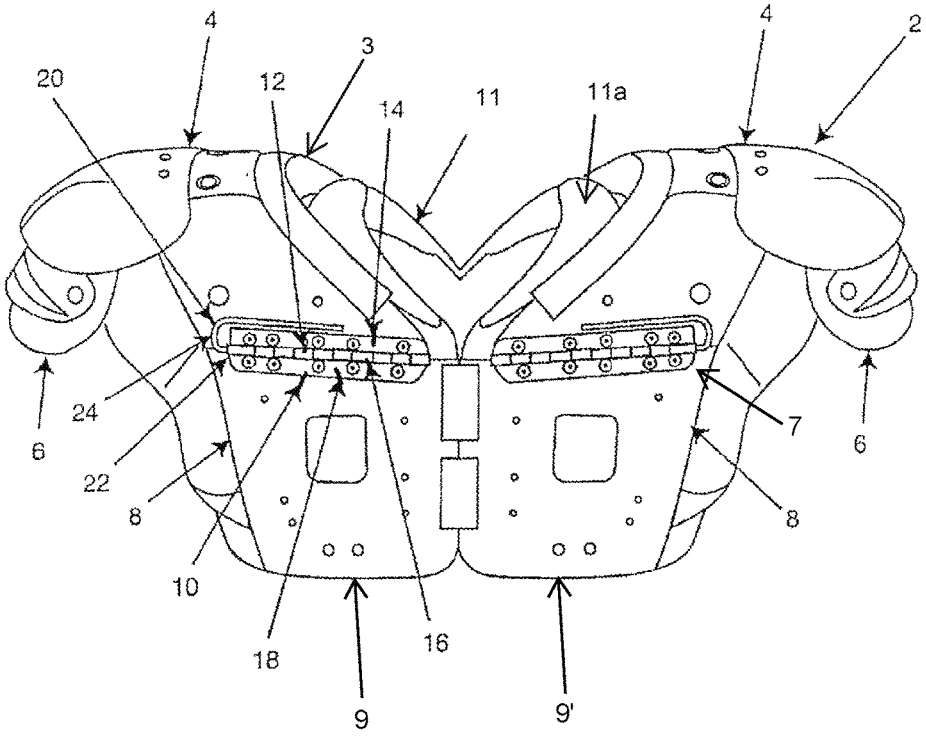
FIG. 1 illustrates a distal plan view of one embodiment of the present invention, in which hinges with the elongated couplers intact are shown as the mechanical connections.
Figure 7:
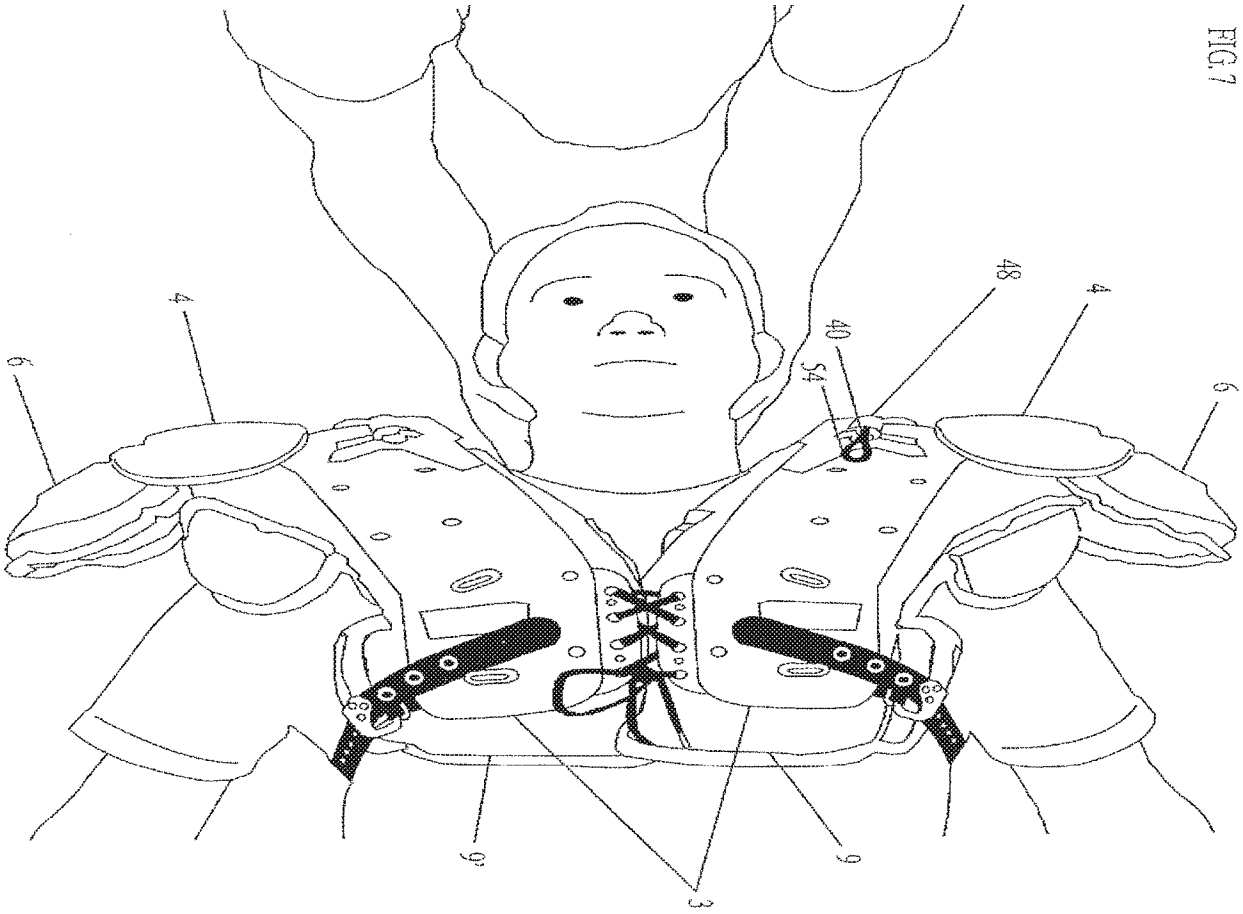
FIG. 7 illustrates a frontal plan view of the embodiment of the present invention illustrated in FIGS. 3 through 6, in which the wearer is in the supine position.

As shown in FIG. 1, an embodiment of the present invention are shoulder pads 2 for use in a contact sport, comprising a left shoulder pad portion 9 and a right shoulder pad portion 9', each with anterior 3, superior 4 and posterior 8 portions, wherein the anterior portions 3 depend from an anterior face of the superior portions 4 and the posterior portions 8 depend from a posterior face of the superior portions 4, wherein the left 9 and right 9' shoulder pad portions are in communication at the anterior 3, superior 4, and posterior 8 portions. The superior portions 4 are spaced a distance apart and define a central opening that is configured to receive the player's head when the shoulder pads 2 are worn by the player, as shown in FIG. 7. The protective shoulder pads 2 protect the chest, shoulders, upper back, and upper arms of the individual wearing the shoulder pads 2. The anterior portions 3 of the shoulder pads 2 protect the individual's chest, the superior portions 4 of the protective shoulder pads 2 protect the individual's shoulders, the posterior portions 8 of the protective shoulder pads 2 protect the individual's upper back, and, if present, the lateral portions 6 of the protective shoulder pads 2 protect the individual's upper arms. As shown in FIG. 1, an internal pad assembly 11 comprised of internal pad members 11*a* extends along the inner surface of the left portion 9 and right portion 9' of pads 2. The left and right portions 9, 9' are formed from a rigid material such that the pads 2 are sufficiently rigid when assembled to dissipate the energy created by an impact to a portion of the left and right portions 9, 9' across substantially the entire shoulder pad 2, including the internal pad assembly 11. As shown in various Figures, the left and right portions 9, 9' have a curvilinear configuration to accommodate the anatomy of the player wearing the pads 2, and thus the left and right portions 9, 9' are referred to as an arch member or collectively as "arches." Therefore, the pads 2 comprise a left and right arches 9, 9' wherein each arch has an internal pad member 11*a* extending along the inner surface of the respective arch 9, 9'.

Figure 18:
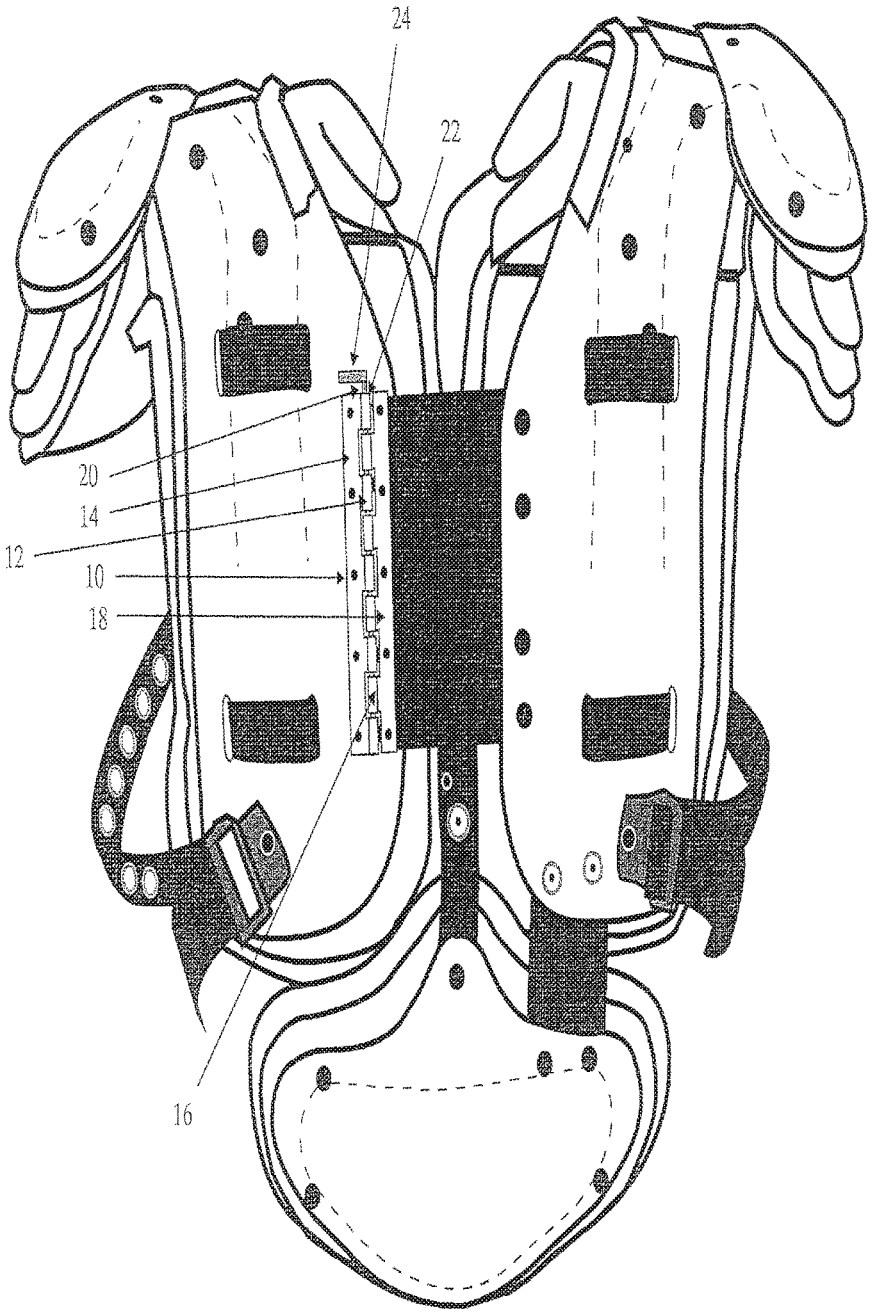
FIG. 18 illustrates a distal plan view of an embodiment of the present invention.
Figure 19:
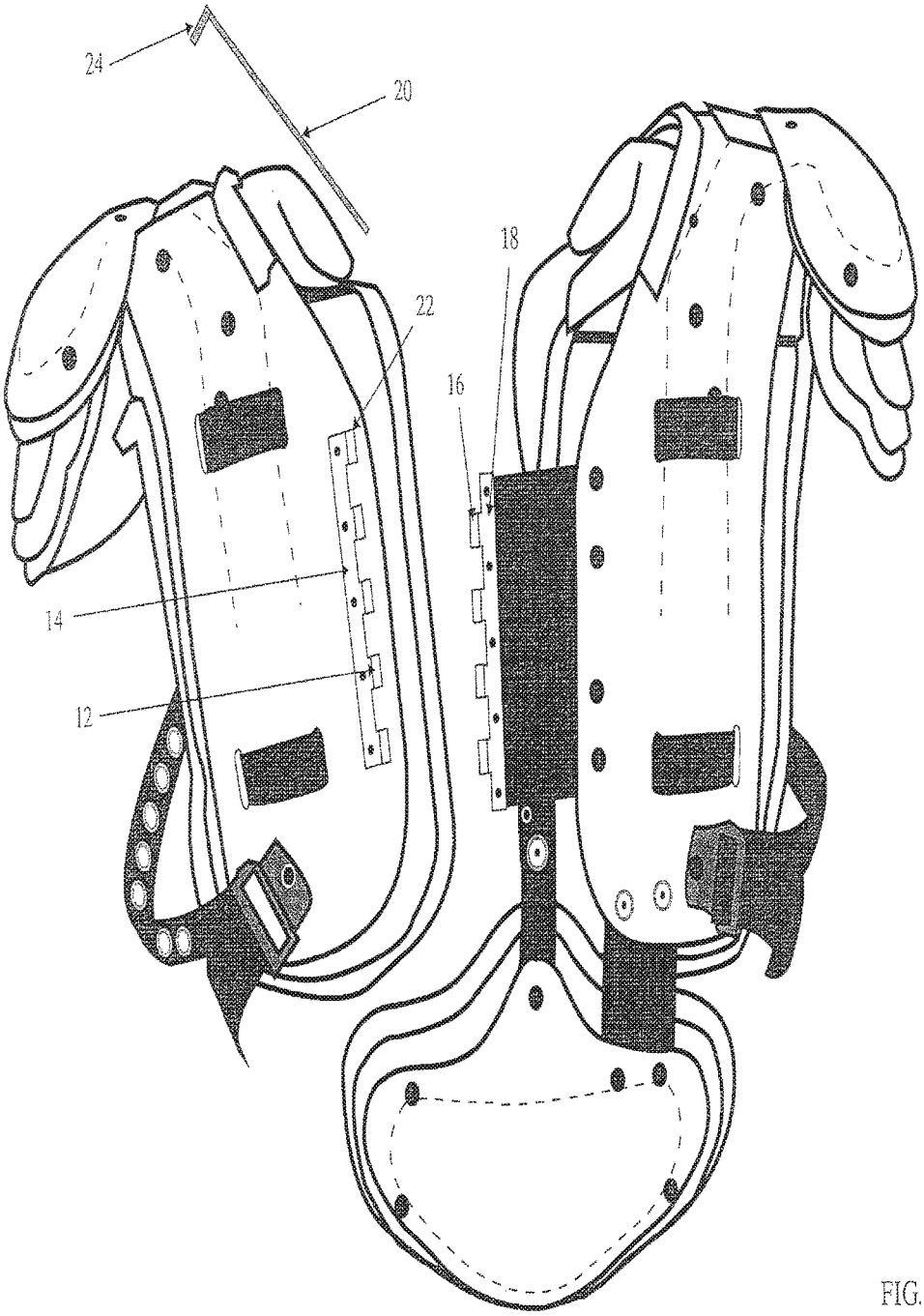
FIG. 19 illustrates a distal plan view of the embodiment of the present invention illustrated in FIG. 18 wherein the elongated coupler has been removed.

Shoulder pads 2 comprise a release mechanism 7 enabling removal of the shoulder pads 2 while the wearer is in the supine position. A portion of the release mechanism 7 is disposed on the posterior portion 8 of the pads, and the release mechanism 7 is operable to separate a first removable portion of the pad from a second removable portion of the pad while the wearer remains in the supine position. The first removable portion of the pad may comprise the posterior portion 8 and the second removable portion may comprise the superior portion 4. In an alternative embodiment, as shown in FIGS. 18 and 19, the first removable portion may comprise the left shoulder pad portion 9 and the second removable portion may comprise the right shoulder pad portion 9'.

As can be seen in FIG. 1, in one embodiment of the present invention release mechanism 7 comprises a hinge-like assembly 10. The hinge assembly 10 may comprise a first hinge knuckle 12, a second hinge knuckle 16, and a removable elongated coupler 20 capable of insertion through the hinge knuckles 12, 16, wherein the first hinge knuckle 12 is disposed on a first removable portion of the pads and the second hinge knuckle 16 is disposed on a second removable portion of the pads, wherein the elongated coupler 20 is threaded through the first knuckle 12 and the second knuckle 16 when the first removable portion of the pads is assembled to the second removable portion of the pads. The removal of the elongated coupler 20 from the first 12 and second 16 knuckles is operable when the wearer is in the supine position. The removal of the elongated coupler 20 decouples the first removable portion from the second removable portion while the wearer remains in the supine position. The elongated coupler 20 may be comprised of a cable, cord, pin, strap, tie, filament, wire, tether, any other suitable structure, or any combination thereof, and may be comprised of metal, plastic, polymer, synthetic, textile, elastic, or any other suitable material.

Figure 2:
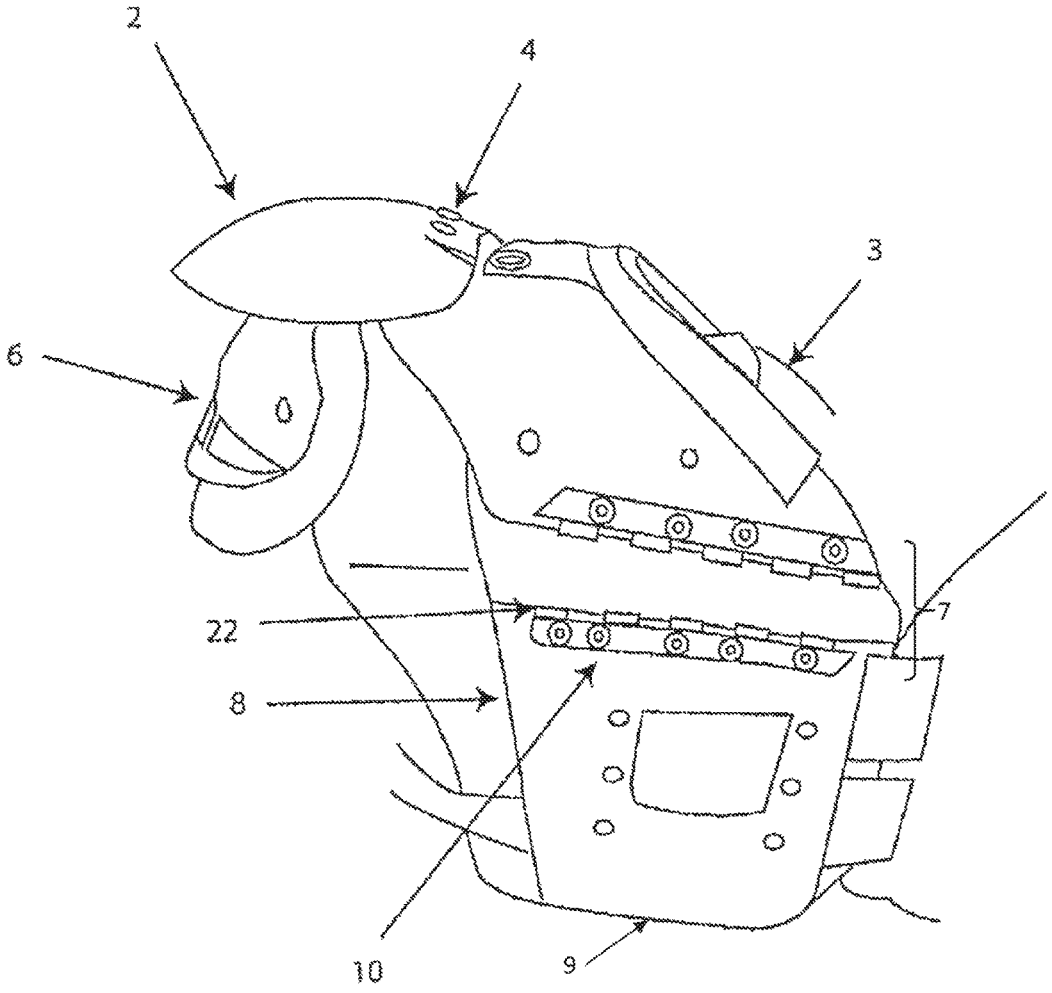
FIG. 2 illustrates a partial distal plan view of the same embodiment of the present invention as shown in FIG. 1, in which one elongated coupler is removed from the hinge.

By way of example only as shown in FIGS. 1 and 2, the following discussion assumes that the first removable portion of the pads are the superior portions 4 and the second removable portions are the posterior portions 8. The knuckles 12 are in communication or disposed on the first removable portion of the pads, or in this example, superior portion 4, and knuckles 16 are in communication with or disposed on the second removable portion of the pads, or in this example, posterior portion 8. The posterior portions 8 of the protective shoulder pads 2 are mechanically coupled to the superior portions 4 of the protective shoulder pads 2 by a release mechanism 7. An elongated coupler 20 is inserted into the hinge opening 22 formed by the apertures in each of the hinge knuckles 12 and the hinge knuckles 16, mechanically and rigidly connecting the superior portion 4 of the protective shoulder pads 2 to the posterior portion 8 of the protective shoulder pads 2. The outer end of the elongated coupler 20 may have a curved end 24 to allow for a person other than the individual wearing the protective shoulder pads to remove the elongated coupler 20 laterally out of the hinge opening 22 while the individual wearing the protective shoulder pads is lying in the supine position.

In one embodiment, comprising hinge leaves 14 and 18, the hinge knuckles 12 of the hinge leaf 14 that is attached to the superior portion 4 of each protective shoulder pad 2 mate at the hinge knuckles 16 of the hinge leaf 18 that is attached to the posterior portion 8 of the protective shoulder pads 2. The hinge leaves 14 and 18 may be chemically bonded, mechanically fastened, or otherwise attached to or molded into the pads by any other suitable means. Alternatively, the superior hinge knuckles 12 and the posterior hinge knuckles 16 can be manufactured into each of the superior portions 4 and posterior portions 8 of the protective shoulder pads 2. In one embodiment hinge knuckles 12 and 16 may be disposed on, or in otherwise communication with, the posterior portion 8 of the left portion 9 and posterior portion 8 of right portion 9'.

FIG. 2 illustrates the state of the protective shoulder pads after one of the elongated couplers 20 is removed from the hinge opening 22 of the hinge assembly 10. Subsequent to removing elongated couplers 20 from each hinge opening 22 on each side of the protective shoulder pads 2, the anterior 3, superior 4, and in this example, lateral 6 portions of the protective shoulder pads 2 can be removed from the individual wearing the protective shoulder pads 2 by separating the anterior portion 3, the superior portion 4, and lateral portion 6 of the protective shoulder pads 2 from the posterior portions 8 of the protective shoulder pads 2. A full diagnosis of the individual who was wearing the protective shoulder pads 2 can then be performed without moving the individual wearing the protective shoulder pads 2 to any detrimental degree. The posterior portions 8 of the protective shoulder pads may be recoupled to the superior portions 4 of the protective shoulder pads 2 for future use.

As shown in FIGS. 18 and 19, the first removable portion of the pad may comprise the left shoulder pad portion 9 and the second removable portion of the pad may comprise the right shoulder pad portion 9'. As shown in FIG. 18, release mechanism 7 comprises a hinge-like assembly 10. The hinge assembly 10 may comprise a first hinge knuckle 12, a second hinge knuckle 16, and a removable elongated coupler 20 capable of insertion through the hinge knuckles 12, 16, wherein the first hinge knuckle 12 is disposed on a first removable portion of the pads and the second hinge knuckle 16 is disposed on a second removable portion of the pads, wherein the elongated coupler 20 is threaded through the first knuckle 12 and the second knuckle 16 when the first removable portion of the pads is assembled to the second removable portion of the pads. The removal of the elongated coupler 20 from the first 12 and second 16 knuckles is operable when the wearer is in the supine position. The removal of the elongated coupler 20 decouples the first removable portion from the second removable portion while the wearer remains in the supine position. The elongated coupler 20 may be comprised of a cable, cord, pin, strap, tie, filament, wire, tether, any other suitable structure, or any combination thereof, and may be comprised of metal, plastic, polymer, synthetic, textile, elastic, or any other suitable material.

By way of example only as shown in FIGS. 18 and 19, the following discussion assumes that the first removable portion of the pads are the left shoulder pad portion 9 and the second removable portions are the right shoulder pad portion 9'. The knuckles 12 are in communication or disposed on the first removable portion of the pads, or in this example, left shoulder pad portion 9, and knuckles 16 are in communication with or disposed on the second removable portion of the pads, or in this example, right shoulder pad portion 9'. The left shoulder pad portion 9 of the protective shoulder pads 2 are mechanically coupled to the right shoulder pad portion 9' of the protective shoulder pads 2 by a release mechanism 7. An elongated coupler 20 is inserted into the hinge opening 22 formed by the apertures in each of the hinge knuckles 12 and the hinge knuckles 16, mechanically and rigidly connecting the left shoulder pad portion 9 of the protective shoulder pads 2 to the right shoulder pad portion 9' of the protective shoulder pads 2. The outer end of the elongated coupler 20 may have a curved end 24 to allow for a person other than the individual wearing the protective shoulder pads to remove the elongated coupler 20 laterally out of the hinge opening 22 while the individual wearing the protective shoulder pads is lying in the supine position.

In one embodiment, comprising hinge leaves 14 and 18, the hinge knuckles 12 of the hinge leaf 14 that is attached to the left shoulder pad portion 9 of each protective shoulder pad 2 mate at the hinge knuckles 16 of the hinge leaf 18 that is attached to the right shoulder pad portion 9' of the protective shoulder pads 2. The hinge leaves 14 and 18 may be chemically bonded, mechanically fastened, or otherwise attached to or molded into the pads by any other suitable means. Alternatively, the superior hinge knuckles 12 and the posterior hinge knuckles 16 can be manufactured into each of the left shoulder pad portion 9 and right shoulder pad portion 9' of the protective shoulder pads 2. As such, hinge knuckles 12 and 16 may be disposed on, or in otherwise communication with, the posterior portion 8 of the left portion 9 and posterior portion 8 of right portion 9'.

FIG. 19 illustrates the protective shoulder pads as the elongated coupler 20 is removed from the hinge opening 22 of the hinge assembly 10. Following removal of elongated coupler 20 from hinge assembly 10, the left portion 9 and right portion 9' of the protective shoulder pads 2 can be removed from the individual wearing the protective shoulder pads 2 by separating the left portion 9 and right portion 9' of the protective shoulder pads 2. A full diagnosis of the individual who was wearing the protective shoulder pads 2 can then be performed without moving the individual wearing the protective shoulder pads 2 to any detrimental degree. The left portion 9 of the protective shoulder pads may be recoupled to the right portion 9' of the protective shoulder pads 2 for future use.

FIG. 3, FIG. 4, FIG. 5, and FIG. 6 illustrate an alternative embodiment of the present invention. The release mechanism 7 may comprise a loop 42 disposed on the first removable portion of the pads, an aperture 46 disposed on the second removable portion of the pads, and a removable elongated coupler 40 with a first extent 40*a* and a second extent 40*b*. The loop 42 is received by the aperture 46, wherein the loop 42 passes through or is threaded through the aperture 46. The loop 42 is then retained in its position through or in the aperture 46 by the insertion of the first extent 40*a* of the removable elongated coupler 40 through the loop 42 following the insertion of loop 42 passing through the aperture 46, thereby assembling the first and second removable portions of the pad. Removal of the elongated coupler 40, namely the first coupler extent 40*a*, from the loop 42 permits egress of the loop 42 back through or from the aperture 46 and permits disassembly of the first removable portion from the second removable portion while the wearer remains in the supine position. The loop 42 may be in communication with or disposed on the posterior portion 8 of the right portion 9' of the pad and the aperture 46 may be in communication with or disposed on the posterior portion 8 of the left portion of the pad 9, or vice versa. In an alternative embodiment, the loop 42 may be in communication with or disposed on the superior portions 4 of the pad and the aperture 46 may be in communication with or disposed on the posterior portions 8 of the pad, or vice versa.

The elongated coupler 40 may be routed from the posterior portion 8 of the pads to the superior portion 4 of the pads, or, in an alternative embodiment, from the posterior portion 8 of the pads, over the superior portion 4 of the pads, and terminating on or near the anterior portion 3 of the pads. The elongated coupler 40 may be comprised of a cable, cord, pin, strap, tie, filament, wire, tether, any other suitable structure, or any combination thereof, and may be comprised of metal, plastic, polymer, synthetic, textile, elastic, or any other suitable material.

Figure 3:
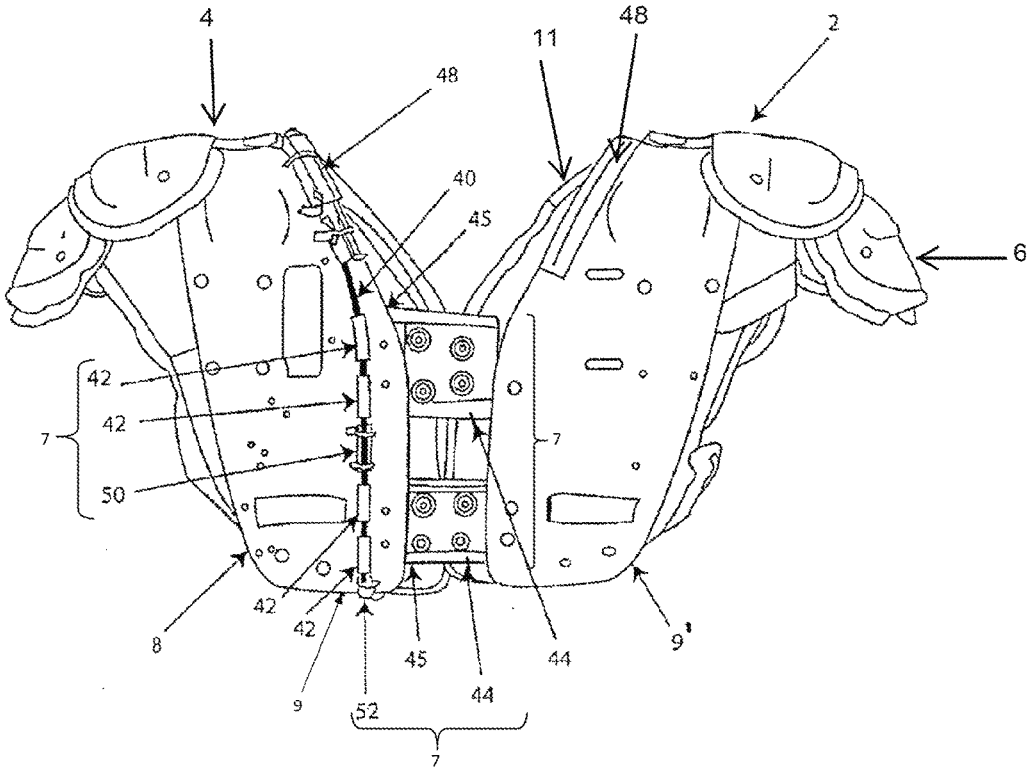
FIG. 3 illustrates a distal plan view of a second embodiment of the present invention, in which a removable cable retains the straps that couple both the left and right halves of the protective shoulder pads.

By way of example only, in this immediate discussion, the first removable portion of the pads is the left portion 9, and the second removable portion of the pads is the right portion 9'. As can be seen in FIG. 3, one embodiment of the present invention comprises an elongated coupler 40 passed through retaining loop 42 that are fabricated onto one end 45 of the straps 44 that couple the left 9 posterior portion 8 of the protective shoulder pads 2 to the right 9' posterior portion 8 of the protective shoulder pads 2. The elongated coupler 40, namely the first coupler extent 40*a*, prevents the retaining loop 42 from passing back through aperture 46 in the body of the protective shoulder pads 2. The elongated coupler 40 is guided along its desired path via superior guidance channel 48 and posterior guidance channel 50 to assist in ease of removal during actuation. In one embodiment, elongated coupler 40 comprises anterior end terminating in an actuation member, such as loop 54. A posterior end of elongated coupler 40 may terminate in a terminating channel 52 disposed on posterior portion 8 of the pads 2.

Figure 4:
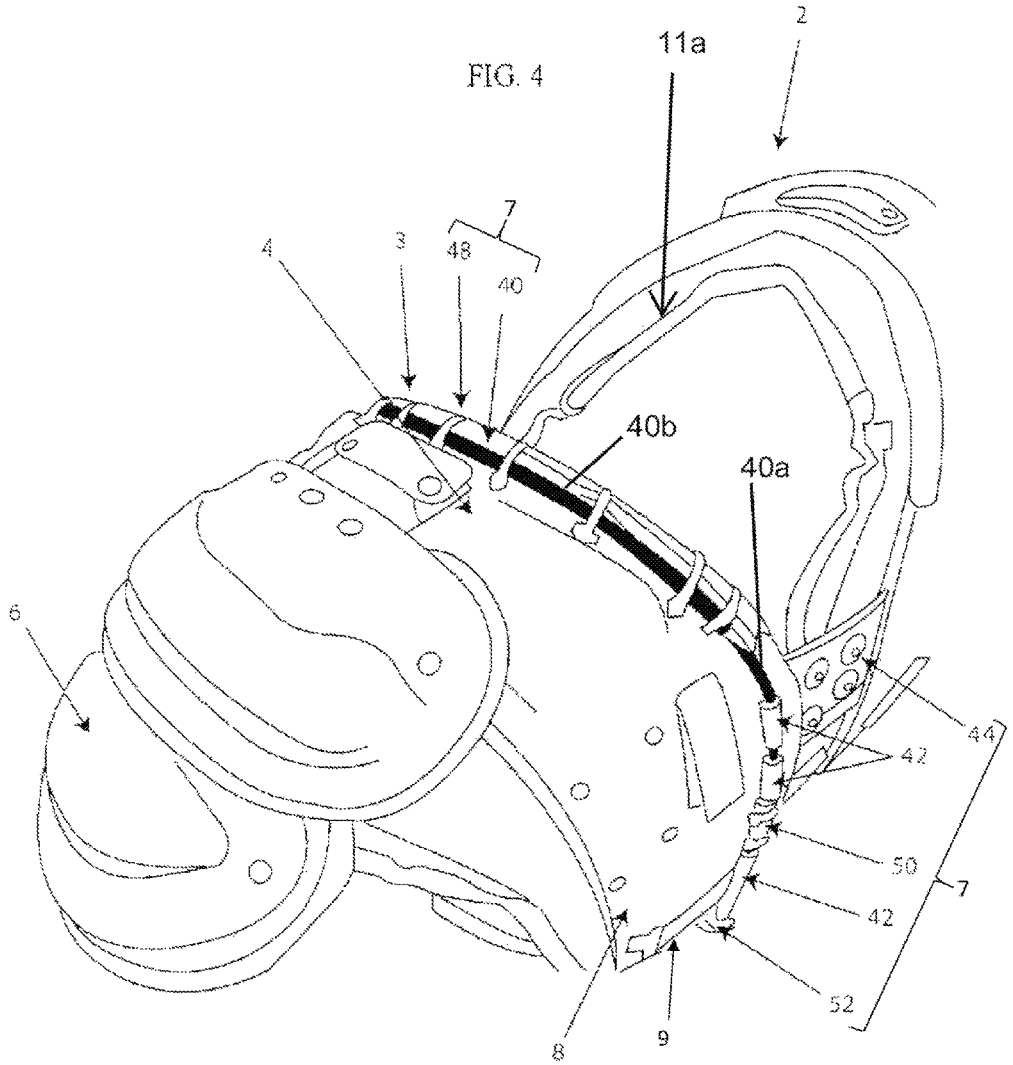
FIG. 4 illustrates a partial lateral prospective view of the embodiment of the present invention illustrated in FIG. 3, in which the removable elongated coupler is channeled towards the anterior portion of the protective shoulder pads.
Figure 5:
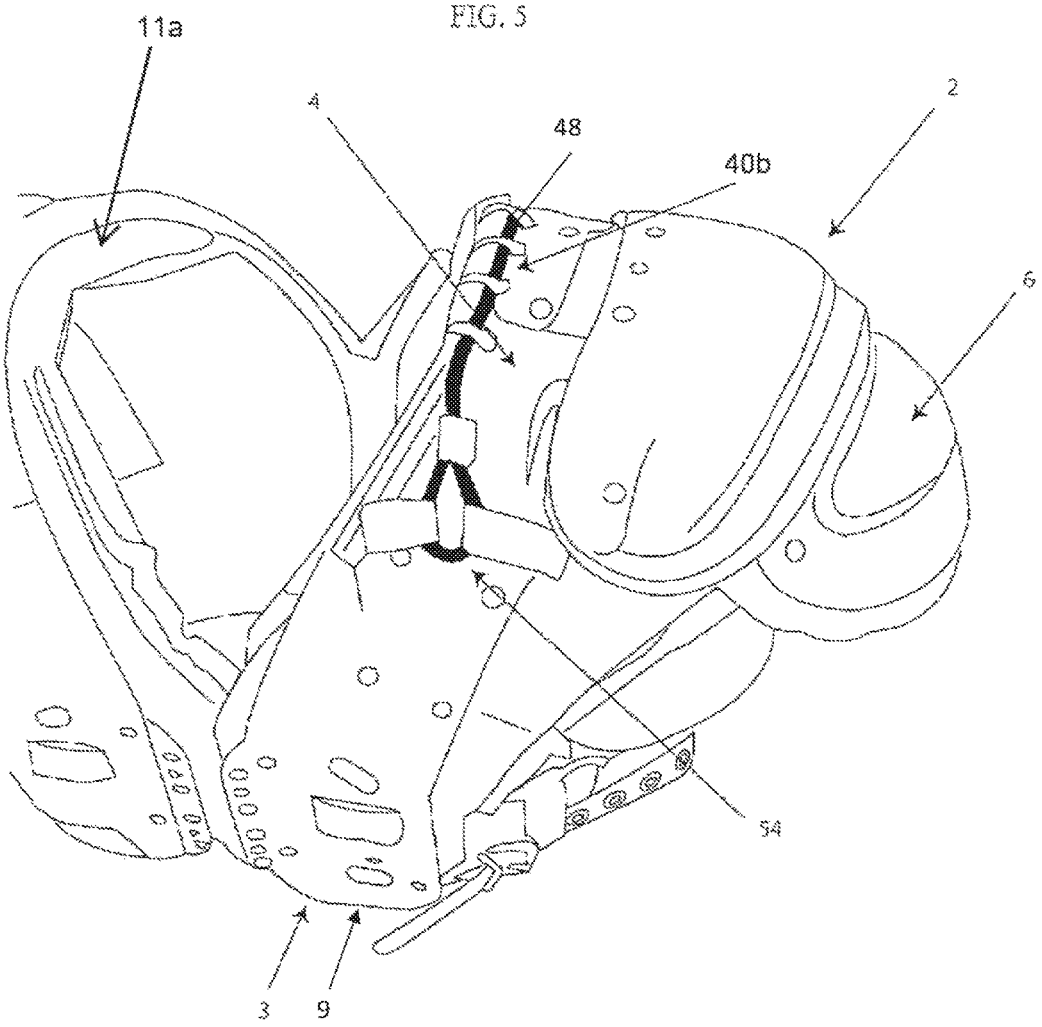
FIG. 5 illustrates a partial frontal prospective view of the embodiment of the present invention illustrated in FIG. 3, in which a loop on the anterior end of the elongated coupler is used to remove the elongated coupler from the straps that couple both the left and right halves of the protective shoulder pads.
Figure 6:
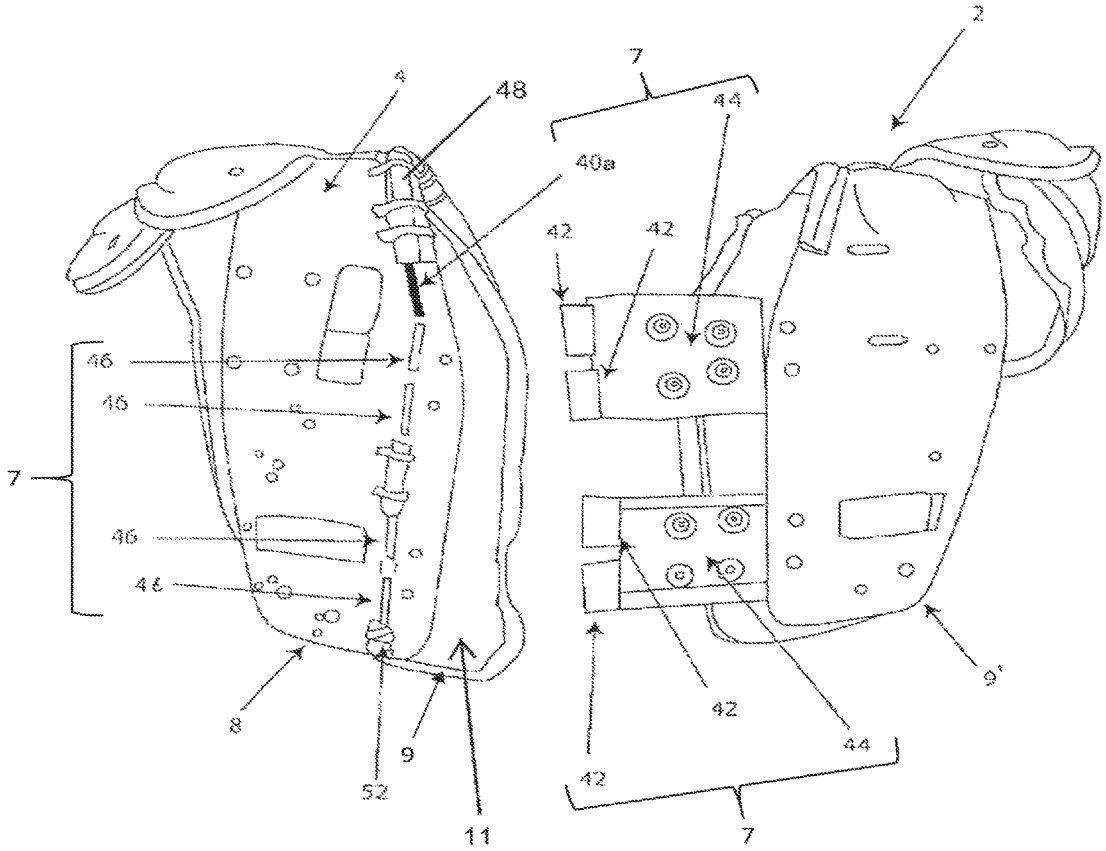
FIG. 6 illustrates a distal plan view of the embodiment of the present invention illustrated in FIG. 3, in which the left and right halves of the protective shoulder pads are decoupled.

As FIG. 4 illustrates, the elongated coupler 40, namely the second coupler extent 40*b*, is routed through the superior guidance channel 48 that extends along the superior portion 4 and towards the anterior portion 3 of the protective shoulder pads 2. As discussed below, the coupler 40, namely the second extent 40*b*, is slidingly received in the guidance channel 48 to allow for actuation of the coupler 40. As FIG. 5 illustrates, the second coupler extent 40*b* and the actuation loop 54 of the elongated coupler 40 terminate near the anterior portion 3 of the protective shoulder pads 2. Returning to FIG. 3, during actuation, with the individual wearing the protective shoulder pads 2 maintained in the supine position, the elongated coupler 40, namely the first coupler extent 40*a*, is removed through retaining loops 42, superior guidance channel 48, posterior guidance channel 50, and terminating channel 52 by pulling on the actuation loop 54 of the elongated coupler 40, effectively releasing the elongated coupler 40, including the first coupler extent 40*a*, from the retaining loops 42, superior guidance channel 48, posterior guidance channel 50, and terminating channel 52. As illustrated in FIG. 6, the retaining loops 42 are now capable of passing back through the apertures 46 in the left 9 posterior portion 8 of the protective shoulder pads 2 with the elongated first coupler extent 40*a* evacuated from the retaining loops 42. With the individual wearing the protective shoulder pads 2 still maintained in the supine position, the anterior coupling that attaches the two anterior portions of the shoulder pads may be separated, thus providing two separate left 9 and right 9' portions of the protective shoulder pads 2. The separate shoulder pads 2 can subsequently be removed laterally from underneath the individual wearing the protective shoulder pads 2 without moving the individual wearing the protective shoulder pads 2 to any detrimental degree. A full diagnosis of the individual wearing the protective shoulder pads 2 is now possible. The left protective shoulder pad 9 and the right protective shoulder pad 9' may be recoupled to form complete protective shoulder pads 2 for future use.

Figure 14:
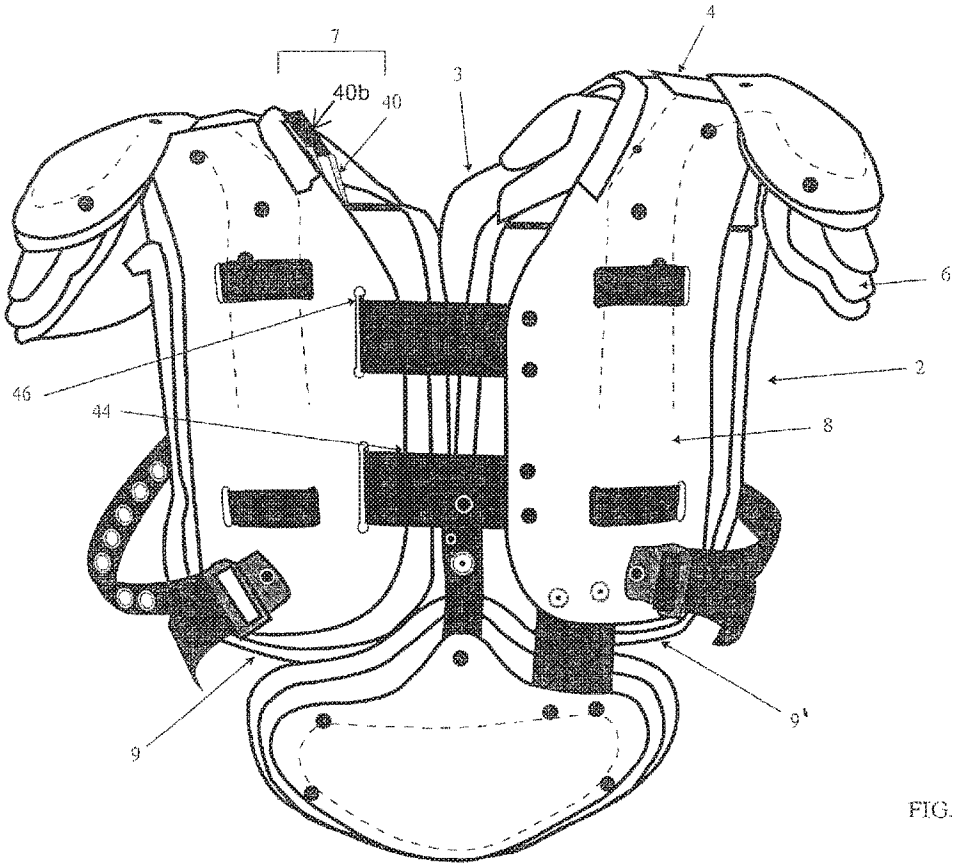
FIG. 14 illustrates a distal plan view of an embodiment of the present invention.
Figure 15:
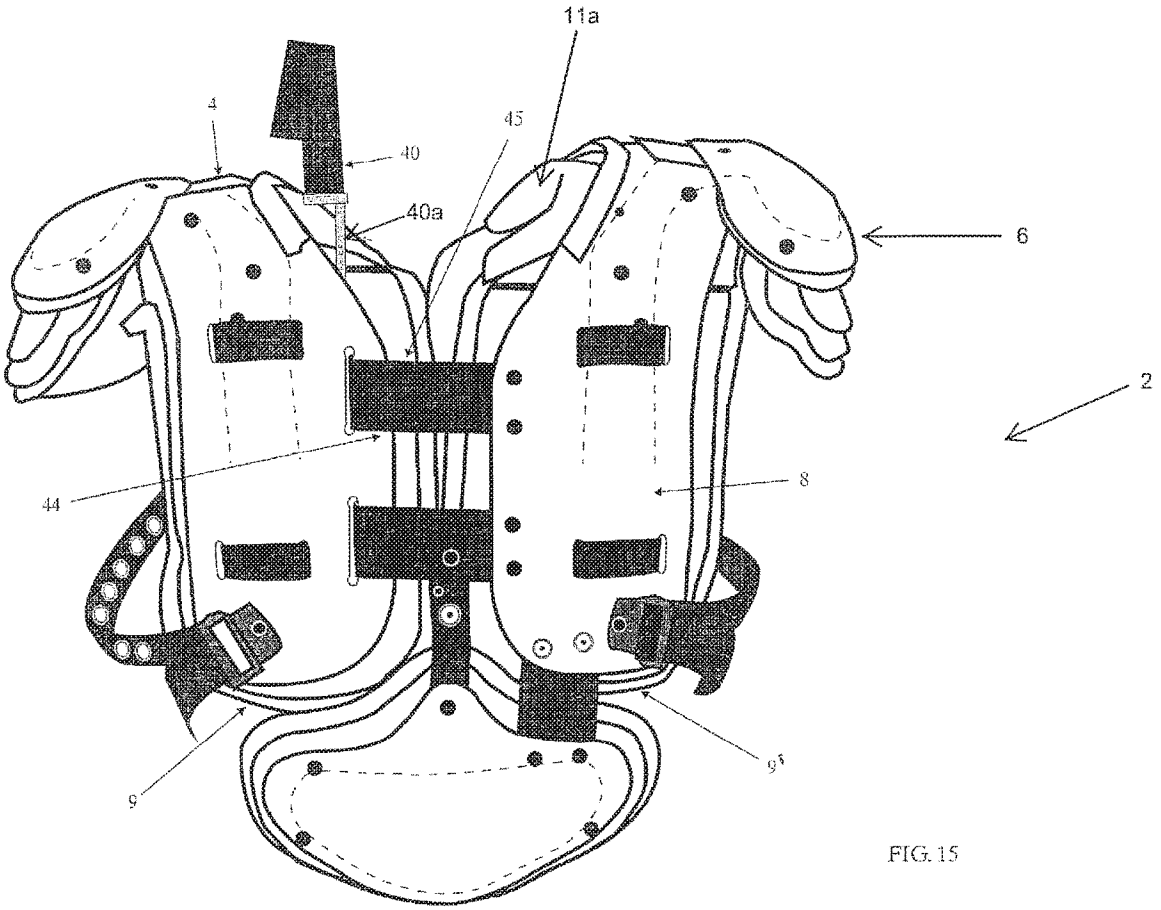
FIG. 15 illustrates a distal plan view of the embodiment of the present invention illustrated in FIG. 14, wherein the elongated coupler is partially removed.
Figure 16:
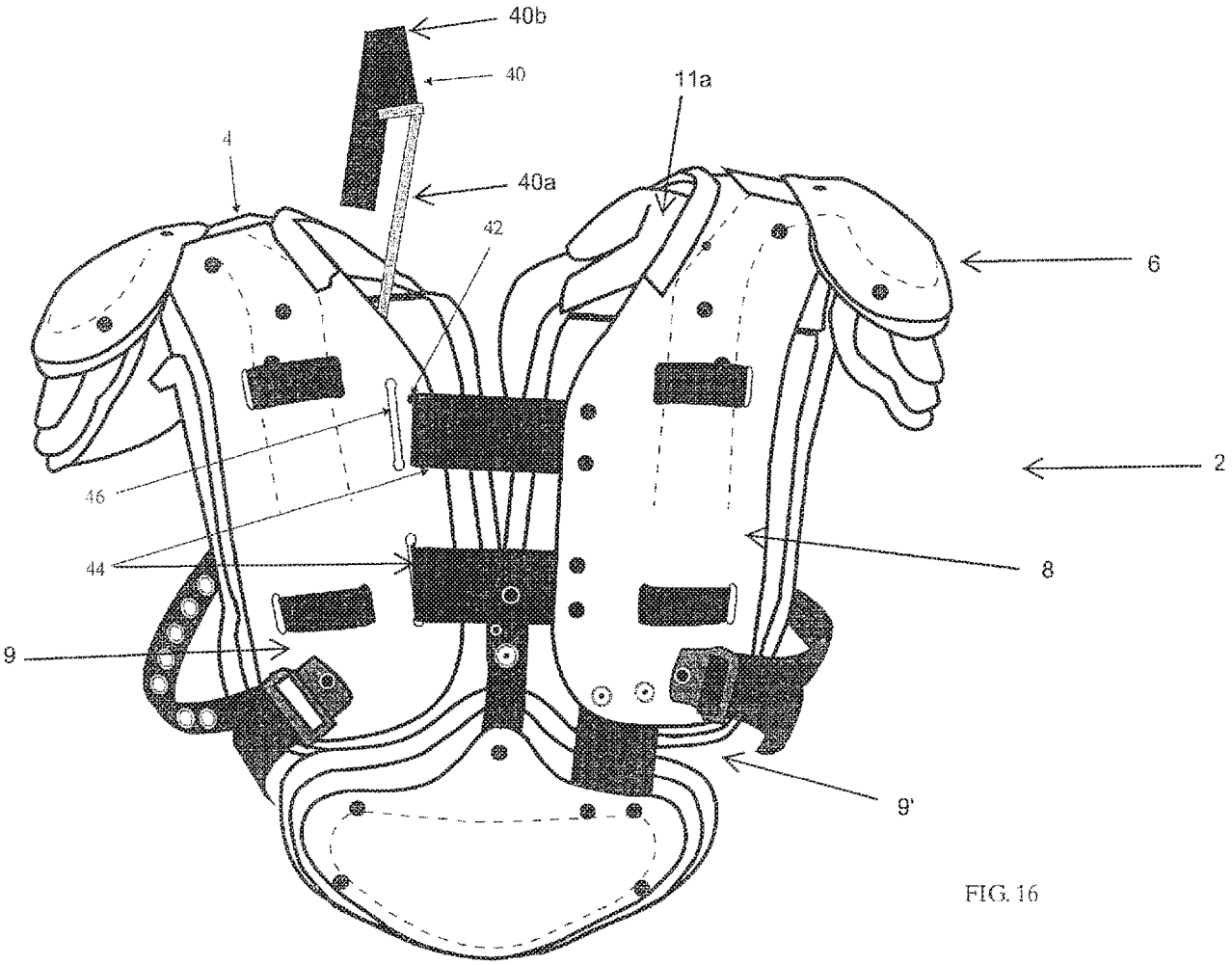
FIG. 16 illustrates a distal plan view of an embodiment of the present invention illustrated in FIG. 14, wherein the elongated coupler is partially removed.

As shown in FIGS. 14-16, a first extent or portion 40*a* of the elongated coupler 40 is routed along an inner surface of the posterior portion 8 of the left portion 9 of pad 2, so as not to be exposed on the outer surface of the posterior portion 8 of pad 2. Thus, the first extent 40*a* of the coupler 40 may extend beneath and along the underside of posterior portion 8 of pad 2, and a second extent 40*b* of the coupler 40 exits near the superior portion 4 of pad 2. Referring to FIG. 14, the second extent 40*b* of elongated coupler 40 may extend over superior portion 4 and is generally exposed and visible before terminating on anterior portion 3 of pads 2. The elongated coupler 40 may be comprised of a cable, cord, pin, strap, tie, filament, wire, tether, any other suitable structure, or any combination thereof, and may be comprised of metal, plastic, polymer, synthetic, textile, elastic, or any other suitable material. Strap 44 extends between the left portion 9 and right portion 9' of pads 2 and comprises a loop 42 (see FIGS. 16 and 17) that passes through aperture 46 and that engages the first extent 40*a* of the coupler 40. Referring to FIGS. 14-17, the first extent 40*a* of the elongated coupler 40 passes through loop 42 on the underside of posterior portion 8 to retain strap 44 in place and to attach left portion 9 and right portion 9' of pads 2.

Figure 17:
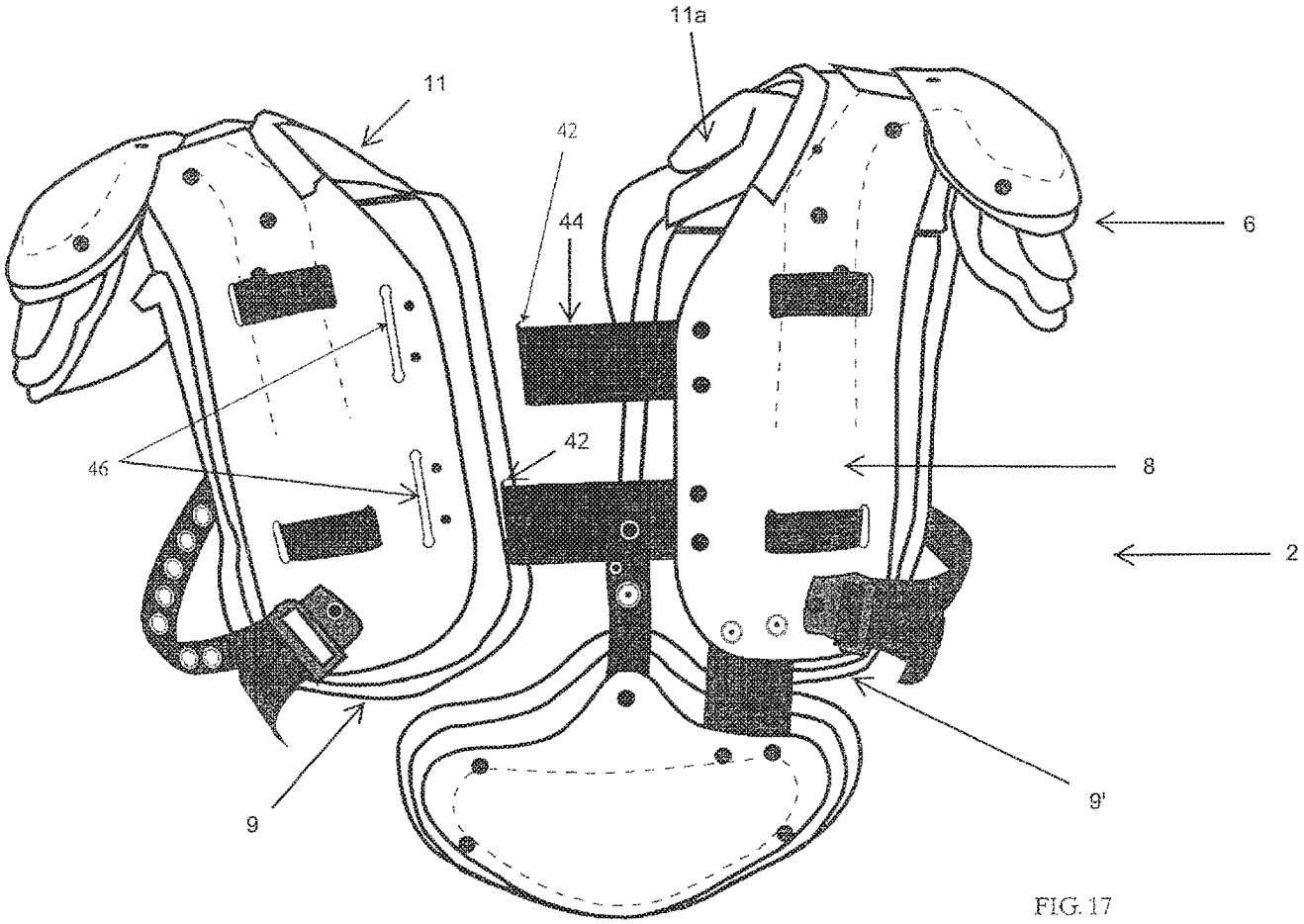
FIG. 17 illustrates a distal plan view of the embodiment of the present invention illustrated in FIG. 14, wherein the elongated coupler is fully removed.

As shown in FIG. 15, elongated coupler 40 may be removed from pad 2 while the wearer is in the supine position. FIG. 16 illustrates the removal of elongated coupler 40 and the release of strap 44 through aperture 46. Also as shown in FIGS. 15 and 16, the elongated coupler 40 is positioned between the left portion 9 of pad 2 and the internal pad assembly 4, including a superior portion of pad element 11*a*. FIG. 17 illustrates the complete removal of elongated coupler 40 and the separation of the left portion 9 and right portion 9' of pads 2.

Figure 8:
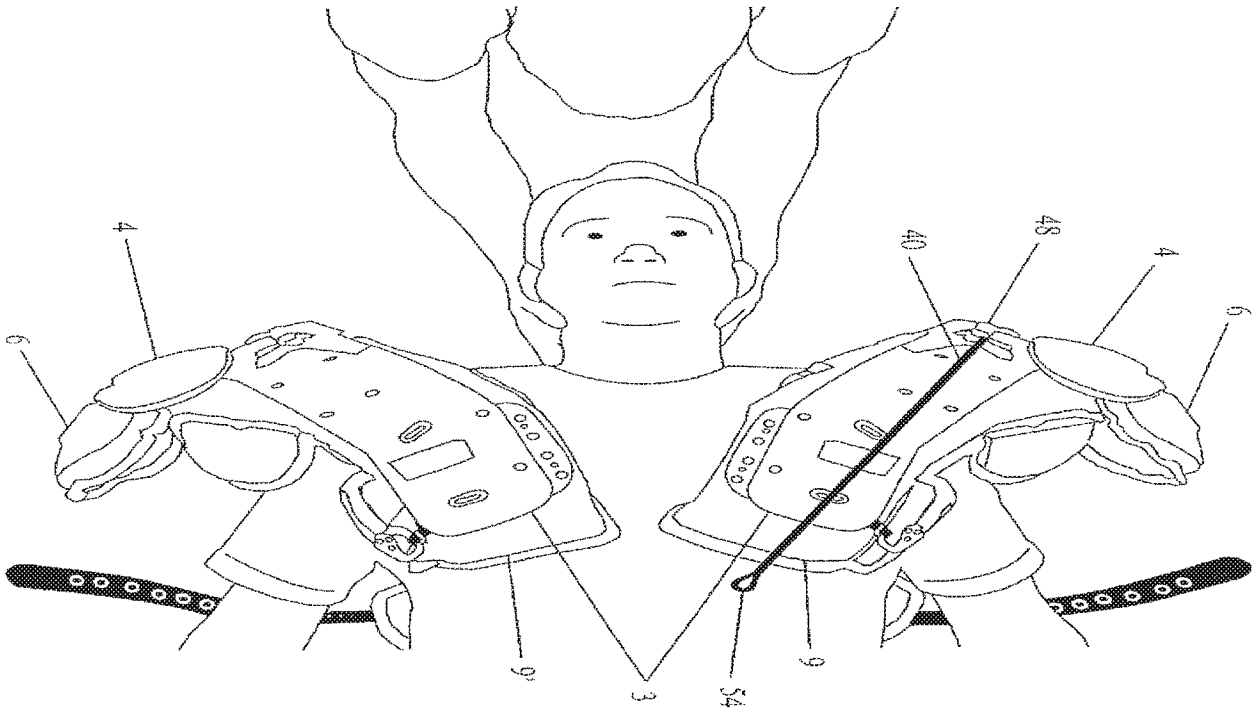
FIG. 8 illustrates a frontal plan view of the embodiment of the present invention illustrated in FIGS. 3 through 6, in which the wearer is in the supine position and the release mechanism has been activated while the wearer remains in the supine position.
Figure 9:
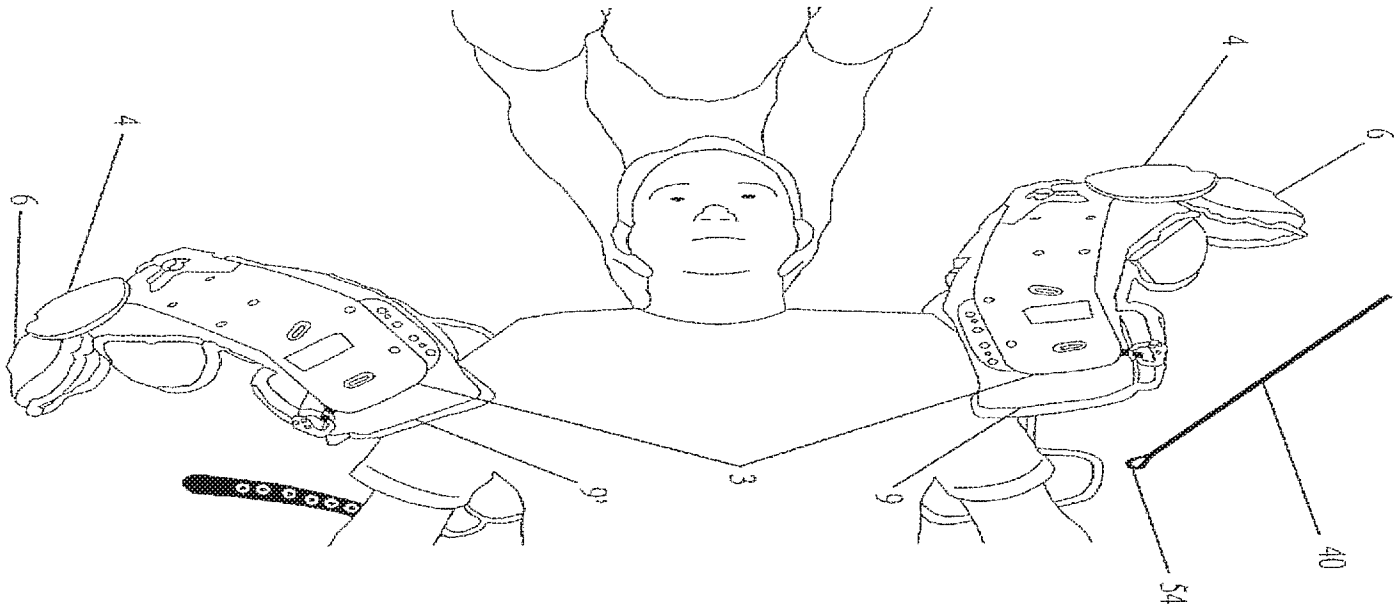
FIG. 9 illustrates a frontal plan view of the embodiment of the present invention illustrated in FIGS. 3 through 6, in which the wearer is in the supine position and the release mechanism activation is complete and the pads are removed while the wearer remains in the supine position.

FIG. 7 illustrates a wearer of pads 2 lying in the supine position with the head being stabilized by another. Pads 2 are fully assembled, and elongated coupler 40 and anterior end 54 are visible and accessible from the anterior portion 3 of pad 2. As shown in FIG. 8, release mechanism 7 is actuated by exerting a pulling force on anterior end 54 of elongated coupler 40, accessed from anterior portion 3 of pads 2 while the wearer remains in the supine position. FIG. 9 illustrates full actuation of release mechanism 7 by the removal of elongated coupler 40, and the separation and removal of pads 2 while the wearer remains in the supine position.

Figure 10:
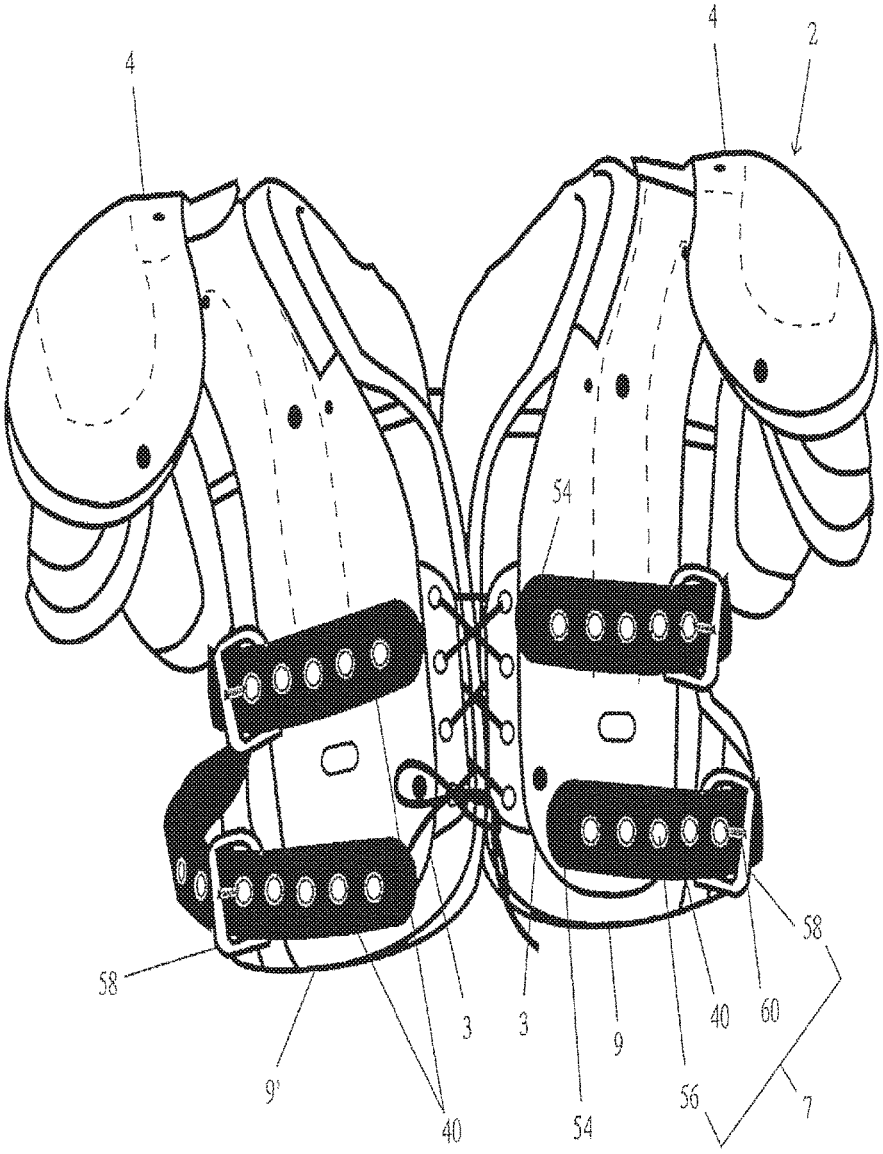
FIG. 10 illustrates a frontal plan view of an embodiment of the present invention wherein the elongated coupler is a belt.

FIG. 10 illustrates an embodiment of the present invention as seen from the front of pads 2 comprising two elongated couplers 40 with anterior ends 54 disposed on the anterior portion 3 of pads 2. Elongated coupler 40 is belt-like in structure and comprises eyelets 56 disposed on at least the portion of elongated coupler 40 that is accessible from anterior portion 3 of pads 2. Buckle 58 is attached to anterior portion 3 of pads 2 and receives anterior end 54 of elongated coupler 40. Buckle 58 comprises prong 60 having a first end and a second end, the first end fixedly or pivotally attached to one wall of buckle 58 and the second end designed to pass through eyelet 56 and rest on a second wall of buckle 58 when elongated coupler 40 and pads 2 are in the assembled position.

Figure 11:
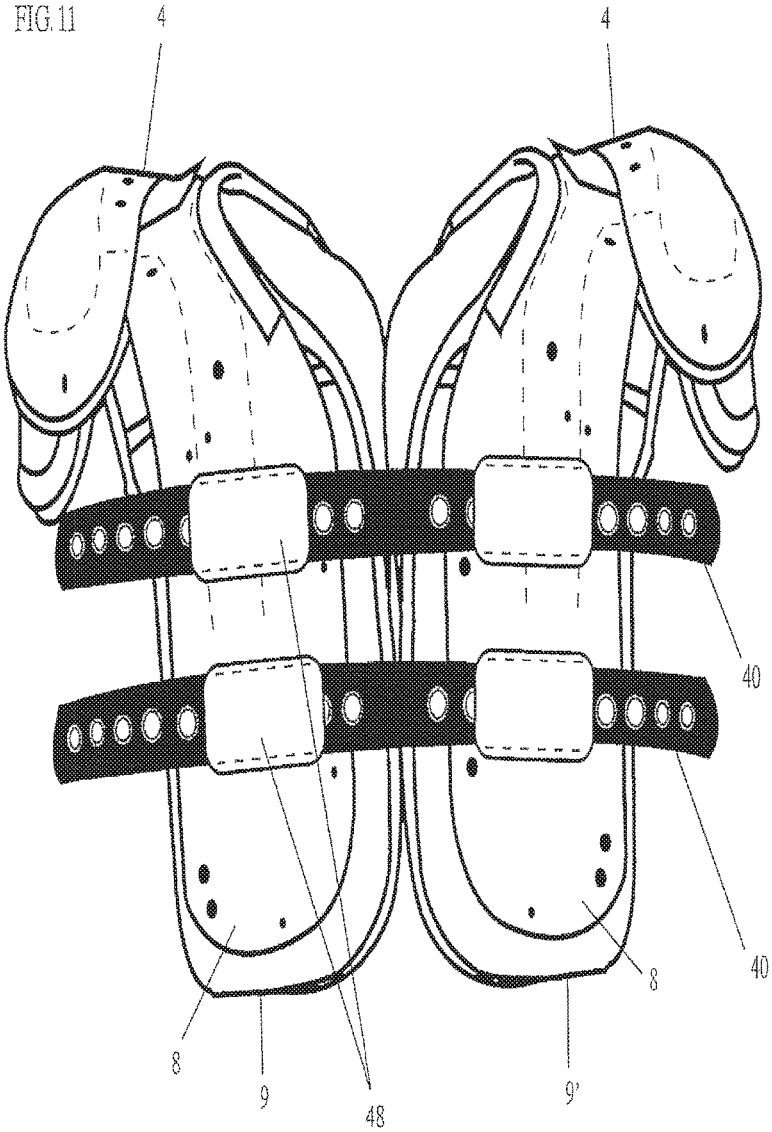
FIG. 11 illustrates a distal plan view of the embodiment of the present invention illustrated in FIG. 10.
Figure 12:
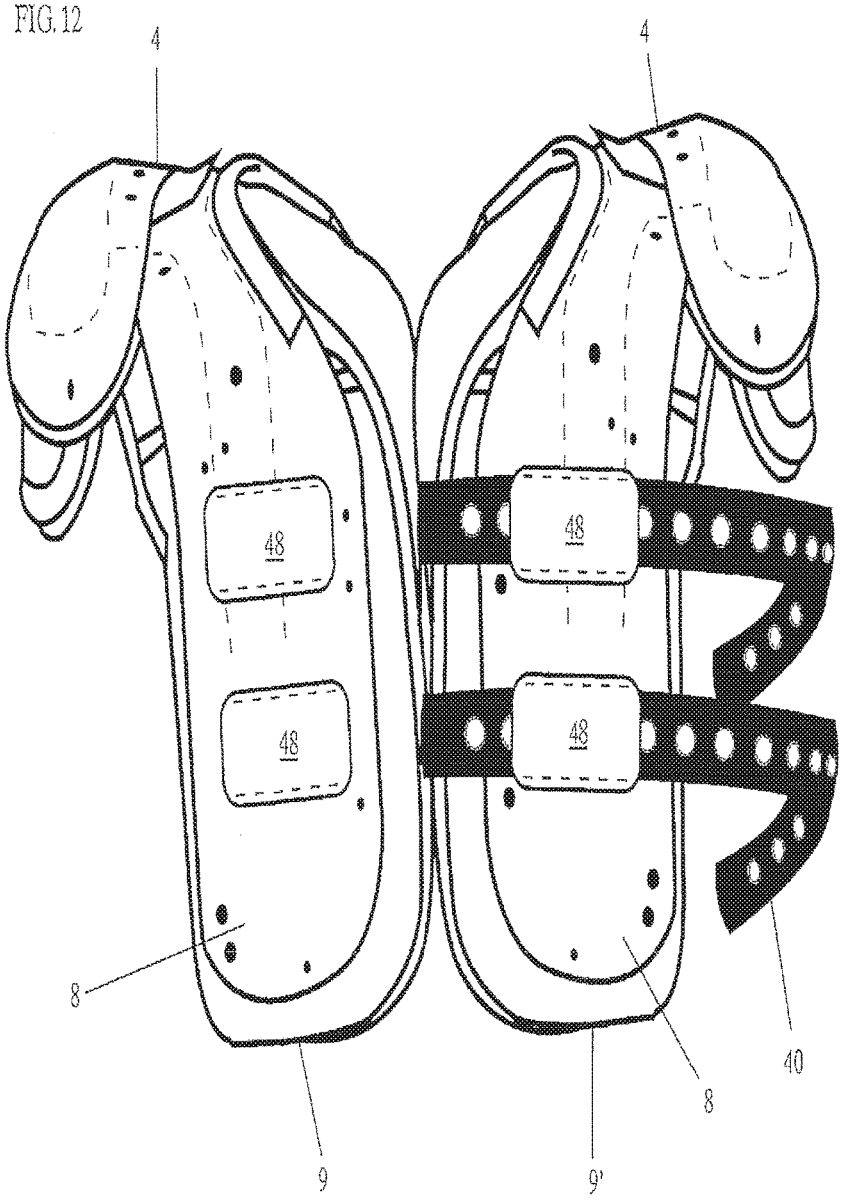
FIG. 12 illustrates a distal plan view of the embodiment of the present invention illustrated in FIG. 10, wherein the elongated coupler has been partially activated.

As shown in FIG. 11, guidance channels 48 are disposed on the posterior portion 8 of pads 2, and act to guide elongated coupler 40 through left shoulder pad portion 9 and right shoulder pad portion 9'. When elongated coupler 40 is secured by buckle 58 and prong 60 on anterior portion 3 of pads 2, pads 2 are assembled. Upon disengagement of prong 60 and buckle 58 from elongated coupled 40 on anterior portion 3 of pads 2, as shown in FIG. 11, elongated coupler 40 may be extracted from guidance channels 48 by exerting a pulling force on either anterior end 54 of elongated coupler 40 accessed from anterior portion 3 of pads 2 while the wearer remains in the supine position. FIG. 12 illustrates the partial removal of elongated coupler 40 from guidance channels 48, permitting the separation and removal of left shoulder pad portion 9 and right shoulder pad portion 9' and removal of pads 2, while the wearer remains in the supine position.

Figure 13:
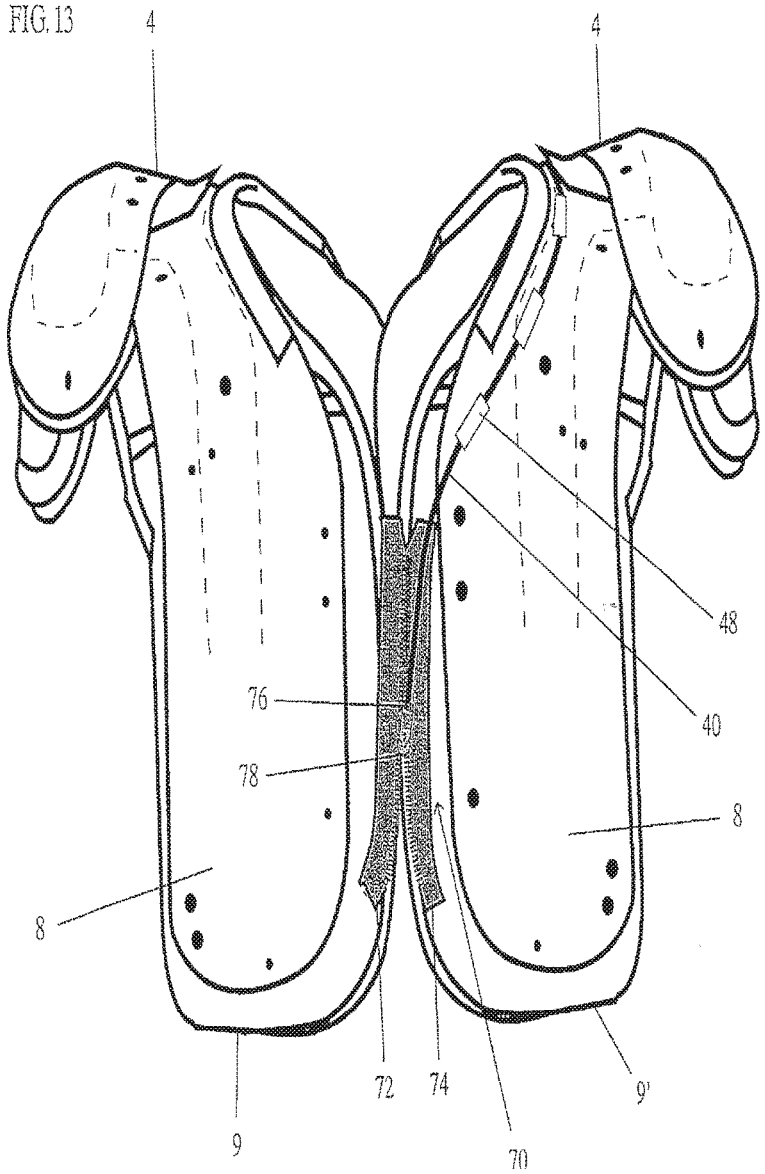
FIG. 13 illustrates a distal plan view of an embodiment of the present invention wherein the elongated coupler comprises a zipper portion.

FIG. 13 illustrates an embodiment of the present invention wherein release mechanism 7 comprises zipper 70 having first portion 72, second portion 74, and elongated coupler 40 comprising slider 78 and tab 76 of zipper 70 and anterior end 54. First portion 72 of zipper 70 is attached to posterior portion 8 of left shoulder pad portion 9 and second portion 74 of zipper 70 is attached to posterior portion 8 of right shoulder pad portion 9'. The portion of elongated coupler 40 comprising tab 76 and slider 78 of zipper 70 is disposed on posterior portion 8 of pads 2. Elongated coupler 40 extends from slider 78 and tab 76 from posterior portion 8, over superior portion 4, with anterior end 54 disposed on and accessible from anterior portion 3 of pads 2. As shown in FIG. 13, release mechanism 7 is partially actuated by exerting a pulling force on anterior end 54 of elongated coupler 40 disposed on anterior portion 3 of pads 2, allowing first portion 72 of zipper 70 and second portion 74 of zipper 70 to disengage while the wearer is in the supine position. As release mechanism 7 is fully actuated, first portion 72 and left shoulder pad portion 9 are disengaged from second portion 74 and right shoulder pad portion 9' and pads 2 may be removed from the wearer while the wearer remains in the supine position.

It will be apparent to those skilled in the art that variations and modifications of the present invention can be made without departing from the scope or spirit of the invention. Thus, it is intended that the present invention cover all such modifications and variations of the invention, provided they come within the scope of the appended claims and their equivalents.

The invention claimed is:

1. Protective shoulder pads to be worn by a player participating in a contact sport, comprising:

a first pad member and a second pad member, wherein each of the first and second pad members have an inner pad element affixed thereto;

the first and second pad members each having a superior portion, an anterior portion depending from the superior portion and a posterior portion depending from the superior portion opposite the anterior portion, wherein the first and second pad members collectively define a central opening;

a release mechanism comprising at least one strap and operably coupling the posterior portion of the first and second pad members to one another, the release mechanism also extending: (i) from the posterior portion of the first pad member, (ii) across the superior portion of the first pad member, and (iii) to the anterior portion of the first pad member, wherein an extent of the release mechanism is accessible when the player is in a supine position; and, wherein when the player wearing the shoulder pads is in the supine position, the release mechanism being operable to separate the first pad member in an opposite lateral direction from the second pad member from underneath the wearer while the wearer remains in the supine position.

2. The shoulder pads of claim 1, wherein the release mechanism comprises:

the at least one strap secured to the posterior portion of the second pad member and extending transversely between the posterior portions of the first and second pad members;

a loop formed at an end portion of the strap; and at least one aperture disposed on the posterior portion of the first pad member, wherein the aperture is dimensioned to receive the loop.

3. The shoulder pads of claim 2, wherein the release mechanism further comprises:

a removable elongated coupler that extends through the loop to secure the strap to the posterior portion of the first pad member and thereby operably couple the first and second pad members in an assembled position.

4. The shoulder pads of claim 3, wherein the end portion of the strap is fed through the aperture whereby the loop resides against an inner surface of the posterior portion of the first pad member in the assembled position.

5. The shoulder pads of claim 3, wherein an extent of the strap resides against an inner surface of the posterior portion of the first pad member in the assembled position.

6. The shoulder pads of claim 3, wherein the elongated coupler extends from the posterior portion of the first pad member across the superior portion of the first pad member proximate the central opening, wherein a first end of the elongated coupler is accessible at said anterior portion.

7. The shoulder pads of claim 1, wherein the release mechanism comprises an elongated coupler that extends from the posterior portion of the first pad member across the superior portion of the first pad member proximate the central opening, wherein a first end of the coupler is accessible at said anterior portion.

8. The shoulder pads of claim 7, wherein an extent of the elongated coupler is positioned between the first pad member and the inner pad element affixed to the first pad member.

9. The shoulder pads of claim 7, wherein the superior portion of the first pad member includes a guidance channel extending along an inner edge of said superior portion, and wherein an extent of the elongated coupler is slidingly received by the guidance channel.

10. The protective shoulder pads of claim 1, wherein the first and a second pad members are configured to dissipate energy created by an impact to a portion of either the first or second members.

11. Protective shoulder pads to be worn by a player participating in a contact sport, comprising:

a first curvilinear arch member and a second curvilinear arch member, wherein each of the first and second curvilinear arch members have an inner pad element affixed thereto;

the first and second curvilinear arch members each having a superior portion, an anterior portion depending from the superior portion and a posterior portion depending from the superior portion opposite the anterior portion, wherein the first and second curvilinear arch members collectively define a central opening; and a release mechanism comprising at least one strap and operably coupling the posterior portion of the first and second curvilinear arch members to one another, the release mechanism also extending from the posterior portion of both the first and second curvilinear arch member and across an extent of the superior portion of the first curvilinear arch member, wherein when the player wearing the protective shoulder pads is in a supine position, an extent of the release mechanism is accessible to allow an operator to actuate the release mechanism to separate the first curvilinear arch member in an opposite lateral direction from the second curvilinear arch member from underneath the wearer while the wearer remains in the supine position.

12. The shoulder pads of claim 11, wherein the release mechanism comprises:

the at least one strap strap secured to the posterior portion of the second curvilinear arch member and extending transversely between the posterior portions of the first and second curvilinear arch members;

a loop formed at an end portion of the strap; and at least one aperture disposed on the posterior portion of the first curvilinear arch member, wherein the aperture is dimensioned to receive the loop.

13. The shoulder pads of claim 12, wherein the release mechanism further comprises: a removable elongated coupler that extends through the loop to secure the strap to the posterior portion of the first curvilinear arch member and thereby operably couple the first and second curvilinear arch members in an assembled position.

14. The shoulder pads of claim 13, wherein the end portion of the strap is fed through the aperture whereby the loop resides against an inner surface of the posterior portion of the first curvilinear arch member in the assembled position.

15. The shoulder pads of claim 13, wherein an extent of the strap resides against an inner surface of the posterior portion of the first curvilinear arch member in the assembled position.

16. The shoulder pads of claim 11, wherein the elongated coupler extends from the posterior portion of the first curvilinear arch member across the superior portion of the first curvilinear arch member proximate the central opening, wherein a first end of the elongated coupler is accessible at said anterior portion.

17. The shoulder pads of claim 11, wherein the release mechanism comprises an elongated coupler that extends from the posterior portion of the first arch member across the superior portion of the first curvilinear arch member proximate the central opening, wherein a first end of the coupler is accessible at said anterior portion.

18. The shoulder pads of claim 17, wherein an extent of the elongated coupler is positioned between the first curvilinear arch member and the inner pad element affixed to the first curvilinear arch member.

19. The shoulder pads of claim 17, wherein the superior portion of the first curvilinear arch member includes a guidance channel extending along an inner edge of said superior portion, and wherein an extent of the elongated coupler is slidingly received by the guidance channel.

20. The protective pad assembly of claim 11, wherein the first and a second curvilinear arch members are configured to dissipate energy created by an impact to a portion of either the first or second members.

* * * * *